US011336018B2

(12) United States Patent
Kimura et al.

(10) Patent No.: US 11,336,018 B2
(45) Date of Patent: May 17, 2022

(54) ANTENNA

(71) Applicant: TDK CORPORATION, Tokyo (JP)

(72) Inventors: Yuichi Kimura, Saitama (JP); Masahiro Tatematsu, Tokyo (JP)

(73) Assignee: TDK CORPORATION, Tokyo (JP)

( * ) Notice: Subject to any disclaimer, the term of this patent is extended or adjusted under 35 U.S.C. 154(b) by 9 days.

(21) Appl. No.: 17/129,171

(22) Filed: Dec. 21, 2020

(65) Prior Publication Data

US 2021/0194134 A1 Jun. 24, 2021

(30) Foreign Application Priority Data

Dec. 24, 2019 (JP) ..... JP2019-233482

(51) Int. Cl.
*H01Q 9/04* (2006.01)

(52) U.S. Cl.
CPC ..... *H01Q 9/045* (2013.01)

(58) Field of Classification Search
CPC .. H01Q 9/0414; H01Q 9/0428; H01Q 9/0435; H01Q 9/0464
See application file for complete search history.

(56) References Cited

U.S. PATENT DOCUMENTS 4,089,003 A * 5/1978 Conroy ..... H01Q 9/0414 343/846
5,099,249 A * 3/1992 Seavey ..... H01Q 21/29 343/700 MS
5,861,848 A * 1/1999 Iwasaki ..... H01Q 9/0435 343/769
6,850,191 B1 * 2/2005 Thill ..... H01Q 5/40 343/700 MS
2013/0099982 A1 * 4/2013 Andrenko ..... H01Q 9/0414 343/700 MS

FOREIGN PATENT DOCUMENTS

JP 2015-111763 A 6/2015

* cited by examiner

*Primary Examiner* — Tung X Le
(74) *Attorney, Agent, or Firm* — Oliff PLC

(57) ABSTRACT

An antenna includes: a dielectric layer including a first and second surface placed in layering; a ring-shaped conductor layer formed on the first surface; a first and second feedline that are closer to the first surface than the second, and are formed at positions different from those of the surfaces; a reference potential conductor layer formed on the second surface; and a conductor pin located in the inner diameter of the ring-shaped conductor layer in planar view from the direction of the layering, that is connected to the reference potential conductor layer. In the planar view, the first and second feedlines include portions overlapping with the ring-shaped conductor layer, and the extending directions of the feedlines intersect with each other. The ring-shaped conductor layer is connected to neither the reference potential conductor layer nor the conductor pin, and neither the first nor second feedline is connected to the conductor pin.

4 Claims, 24 Drawing Sheets

ANTENNA

CROSS-REFERENCE TO RELATED APPLICATION

This application claims the benefit of Japanese Patent Application No. 2019-233482, filed on Dec. 24, 2019, the entire disclosure of which is incorporated by reference herein.

FIELD

The present disclosure relates to an antenna that can use a plurality of polarized waves in common.

BACKGROUND

In recent years, demands for high-speed communication have been increased with an increase in the amount of the information of communication data. Methods using a plurality of frequency bands, orthogonal polarizations, and the like have been utilized as methods of performing high-speed communication. For example, Unexamined Japanese Patent Application Publication No. 2015-111763, which is a Japanese patent literature, discloses an antenna technology in which vertically and horizontally polarized waves can be utilized by orthogonally arranging antenna elements.

In the case of utilizing a dual orthogonally polarized antenna in which antenna elements are orthogonally arranged, it is desirable that vertically and horizontally polarized waves can be independently transmitted and received without interfering with each other. Therefore, it is necessary to secure isolation between the vertically and horizontally polarized waves. However, isolation is low in the operating frequency band of the antenna in the technology disclosed in Unexamined Japanese Patent Application Publication No. 2015-111763. This means that polarized waves transmitted and received by one antenna element leak to the other antenna element. Therefore, the technology disclosed in Unexamined Japanese Patent Application Publication No. 2015-111763 has a problem that it is difficult to use the technology in high-speed communication because the technology has poor isolation characteristics in the operating frequency band of the antenna.

The present disclosure solves the problem described above, and an objective of the present disclosure is to provide an antenna with favorable isolation characteristics in an operating frequency band.

SUMMARY

In order to achieve the objective described above, an antenna according to the present disclosure includes:

a dielectric layer including a first surface and a second surface that is different from the first surface, the first surface and the second surface being placed in layering;

a first ring-shaped conductor layer with a ring shape, formed on the first surface;

a first feedline and a second feedline that are closer to the first surface than to the second surface, and that are formed at positions different from positions of the first surface and the second surface;

a reference potential conductor layer formed on the second surface; and a conductor pin that is located in an inner diameter of the first ring-shaped conductor layer in planar view from a direction of the layering, and that is connected to the reference potential conductor layer, wherein the first feedline and the second feedline include portions overlapping with the first ring-shaped conductor layer in the planar view from the direction of the layering, an extending direction of the first feedline and an extending direction of the second feedline intersect with each other in the planar view from the direction of the layering, the first ring-shaped conductor layer is connected to neither the reference potential conductor layer nor the conductor pin, and neither the first feedline nor the second feedline is connected to the conductor pin.

In accordance with the present disclosure, since isolation can be increased in an operating frequency band by disposing a pin connected to a reference potential conductor layer in the inner diameter of a ring-shaped conductor layer included in an antenna in planar view from the direction of layering, the antenna with favorable isolation characteristics can be provided.

BRIEF DESCRIPTION OF THE DRAWINGS

A more complete understanding of this application can be obtained when the following detailed description is considered in conjunction with the following drawings, in which.

DETAILED DESCRIPTION

Figure 1A:
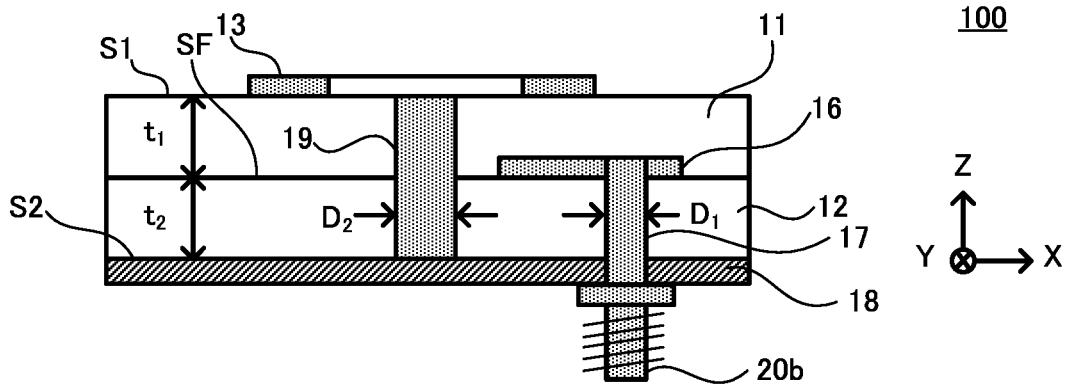
FIG. 1A is a cross-sectional view of an antenna according to Embodiment 1.

Embodiments of the present disclosure will be described in detail below with reference to the drawings. In the drawings, the same or equivalent portions are denoted by the same reference characters.

Embodiment 1

Figure 1B:
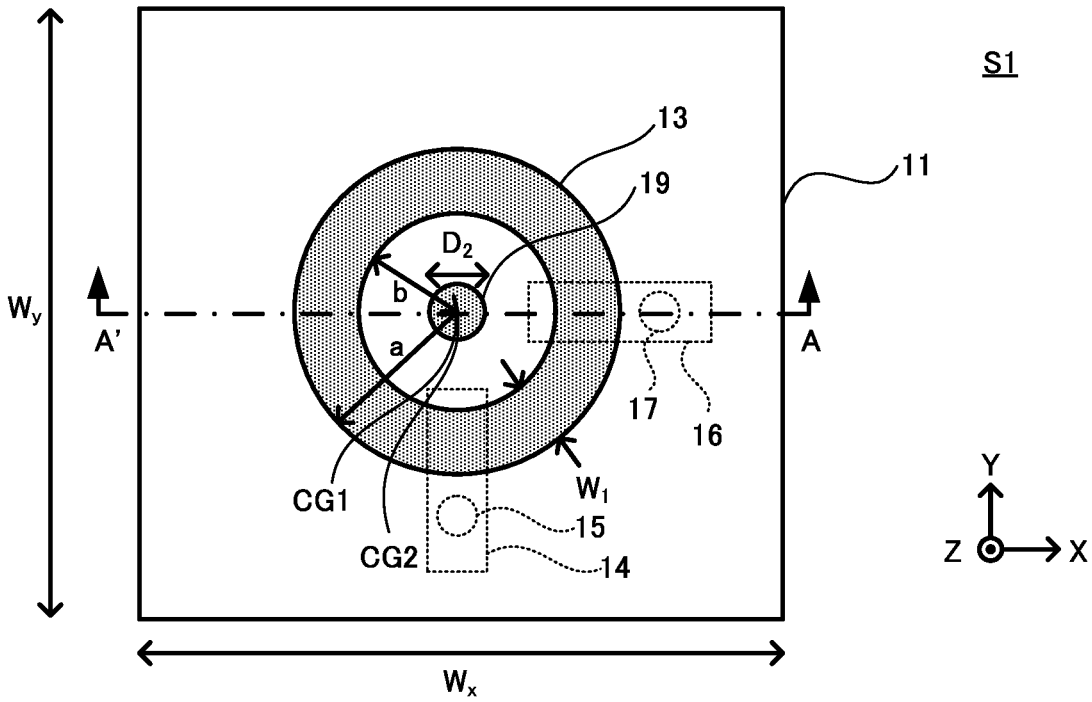
FIG. 1B is a plan view of a first surface of the antenna according to Embodiment 1.
Figure 1C:
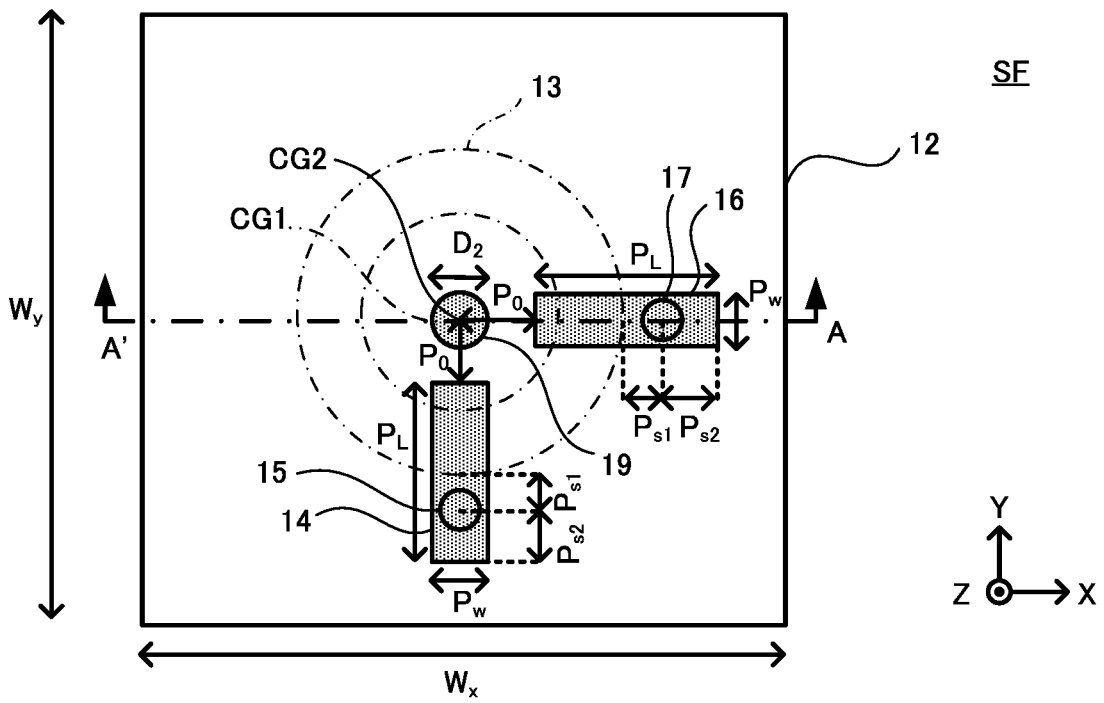
FIG. 1C is a plan view of a surface, on which feedlines are formed, of the antenna according to Embodiment 1.

The configurations of a dual polarized antenna 100 according to Embodiment 1 will be described with reference to FIGS. 1A to 1C. FIG. 1A is a cross-sectional view of the dual polarized antenna 100. FIG. 1B is a plan view of a first surface S1, and FIG. 1C is a plan view of a surface SF on which feedlines are formed. FIG. 1A corresponds to a cross-sectional view taken along the arrow A-A' in FIGS. 1B and 1C. In FIGS. 1A to 1C, some members are hatched for identifying the members even in a case in which the members are illustrated in the cross-sectional view. In FIG. 1B and FIG. 1C, some originally invisible members are indicated by alternate long and short dash lines, to clarify positional relationships. Even in the case of the cross-sectional view, some members may be prevented from being hatched, to facilitate visual identification of the view.

Explanation will be given below while appropriately referring to a set XYZ orthogonal coordinate system in which the crosswise direction of the dual polarized antenna 100 illustrated in FIG. 1A is set at the X-axis direction, the height direction of the dual polarized antenna 100 is set at the Z-axis direction, and the direction orthogonal to the X- and Z-axis directions is set at the Y-axis direction. In the following explanation, a direction from the +Z-axis direction to the −Z-axis direction is referred to as the direction of layering.

As illustrated in FIGS. 1A to 1C, the dual polarized antenna 100 includes a first dielectric layer 11, a second dielectric layer 12, a ring-shaped conductor layer 13, a first feedline 14, a first feed port 15, a second feedline 16, a second feed port 17, a reference potential conductor layer 18, and a conductor pin 19.

Each of the first dielectric layer 11 and the second dielectric layer 12 is formed in a flat plate shape. The first dielectric layer 11 and the second dielectric layer 12 are layered to form a dielectric layer that supports the whole dual polarized antenna 100. The first dielectric layer 11 has a thickness $t_1$, and the second dielectric layer 12 has a thickness $t_2$. The first dielectric layer 11 and the second dielectric layer 12 have the same rectangular external shape in planar view from the direction of the layering. The first dielectric layer 11 and the second dielectric layer 12 are formed of a dielectric material such as, for example, Teflon (registered trademark), ceramic, or epoxy resin.

In the dual polarized antenna 100 illustrated in FIGS. 1A to 1C, a principal surface in the +Z-axis direction of the first dielectric layer 11 is referred to as the first surface S1, and a principal surface in the −Z-axis direction of the second dielectric layer 12 is referred to as a second surface S2. A principal surface in the +Z-axis direction of the second dielectric layer 12, the principal surface being located between the first surface S1 and the second surface S2, and coming in contact with the first dielectric layer 11, is referred to as the surface SF on which the feedlines are formed. Since the first dielectric layer 11 and the second dielectric layer 12 are layered as described above, the first surface S1, the surface SF on which the feedlines are formed, and the second surface S2 in the order mentioned above are placed in layering.

The ring-shaped conductor layer 13 is a radiating element for transmitting and receiving first and second polarized waves. The ring-shaped conductor layer 13 is formed in a ring shape, obtained by hollowing out the central portion of a circle, in planar view from the direction of the layering. The ring-shaped conductor layer 13 is formed on the first surface S1 of the first dielectric layer 11.

The first feedline 14 and the second feedline 16 are closer to the first surface S1 than to the second surface S2, and are formed at positions different from the positions of the first surface S1 and the second surface S2. In the dual polarized antenna 100 illustrated in FIGS. 1A to 1C, the first feedline 14 and the second feedline 16 are formed on the surface SF on which the feedlines are formed, the surface SF being sandwiched between the first dielectric layer 11 and the second dielectric layer 12. Each of the first feedline 14 and the second feedline 16 is formed in a rectangular shape in planar view from the direction of the layering. The extending directions of the first feedline 14 and the second feedline 16 intersect orthogonally with each other in planar view from the direction of the layering. The first feedline 14 and the second feedline 16 are spaced from each other. The first feedline 14 and the second feedline 16 include portions overlapping with the ring-shaped conductor layer 13 in planar view from the direction of the layering, respectively.

The first feed port 15 is formed in a columnar or cylindrical shape, and passes through a through-hole formed in the second dielectric layer 12. One end of the first feed port 15 is connected to the first feedline 14, the other end of the first feed port 15 is connected to a signal wire (inner conductor) of a first coaxial connector 20*a* (not illustrated). The first feed port 15 is connected to an external signal source through the signal wire of the first coaxial connector 20*a*. The second feed port 17 is formed in a columnar or cylindrical shape, and passes through a through-hole formed in the second dielectric layer 12. One end of the second feed port 17 is connected to the second feedline 16, and the other end of the second feed port 17 is connected to a signal wire (inner conductor) of a second coaxial connector 20*b*. The second feed port 17 is connected to the external signal source through the signal wire of the second coaxial connector 20*b*. Hereinafter, the first coaxial connector 20*a* and the second coaxial connector 20*b* are collectively referred to as coaxial connectors 20. In the case of transmission, high-frequency signals to be transmitted are independently fed from the external signal source to the first feed port 15 and the second feed port 17 through the coaxial connectors 20. In the case of reception, the high-frequency signals received from the external signal source are output to the coaxial connectors 20 through the first feed port 15 and the second feed port 17, respectively.

The reference potential conductor layer 18 includes a conductor layer placed on the second surface S2 of the second dielectric layer 12, and has a potential which is a reference potential (ground potential which is a zero potential). The reference potential conductor layer 18 is insulated from the first feed port 15 and the second feed port 17. The reference potential conductor layer 18 is connected to the outer conductors of the coaxial connectors 20.

The conductor pin 19 passes through a through-hole formed in the first dielectric layer 11 and the second dielectric layer 12. One end of the conductor pin 19 is connected to the reference potential conductor layer 18, and the other end of the conductor pin 19 is located in the center position of the ring-shaped conductor layer 13 on the first surface S1 of the first dielectric layer 11. By the first dielectric layer 11 and the second dielectric layer 12, the ring-shaped conductor layer 13 is insulated from the reference potential conductor layer 18 and the conductor pin 19, and is prevented from being connected to the reference potential conductor layer 18 and the conductor pin 19. By the first dielectric layer 11 and the second dielectric layer 12, the first feedline 14 and the second feedline 16 are insulated from the conductor pin 19, and is prevented from being connected to the conductor pin 19. Since the conductor pin 19 is connected to the reference potential conductor layer 18, the potential of the conductor pin 19 is equal to a reference potential, and the potential of the center position of the ring-shaped conductor layer 13 is close to the reference potential. The conductor pin 19 is formed in a columnar or cylindrical shape, and extends in the Z-axis direction. The conductor pin 19 is placed so that the center of gravity CG2 of the conductor pin 19 fits with the central portion of the inner diameter of the ring-shaped conductor layer 13, that is, the center of gravity CG1 of the ring-shaped conductor layer 13, in planar view from the direction of the layering.

The ring-shaped conductor layer 13, the first feedline 14, the second feedline 16, and the reference potential conductor layer 18 include a conductor film, foil, or plate, or the like. The ring-shaped conductor layer 13, the first feedline 14, the second feedline 16, the reference potential conductor layer 18, the first feed port 15, the second feed port 17, and the conductor pin 19 are formed of a conductor, for example, copper, gold, aluminum, or the like.

The first dielectric layer 11 and the second dielectric layer 12 may be separately or integrally formed.

Operation of the dual polarized antenna 100 including the above-described configurations will now be described. During transmission operation, first and second high-frequency signals to be transmitted (the signals themselves may be identical) are independently fed to the first feed port 15 and the second feed port 17. The first high-frequency signal is fed to the ring-shaped conductor layer 13 through the first feed port 15 and the first feedline 14. The second high-frequency signal is fed to the ring-shaped conductor layer 13 through the second feed port 17 and the second feedline 16. The first and second high-frequency signals are fed to the ring-shaped conductor layer 13, from the directions of the first and second high-frequency signals, orthogonal to each other. As a result, the ring-shaped conductor layer 13 radiates first and second polarized waves of which the principal polarization planes are orthogonal to each other.

During reception operation, the first and second polarized waves reaching the dual polarized antenna 100 are received by the ring-shaped conductor layer 13. The first polarized wave is output from the first feed port 15 through the first feedline 14. The second polarized wave is output from the second feed port 17 through the second feedline 16.

For favorably transmitting and receiving first and second high-frequency signals in the dual polarized antenna 100, it is necessary to decrease a value of $S_{21}$ or $S_{12}$ which is an S-parameter representing a degree (dB) at which a high-frequency signal fed to one of the first feed port 15 and the second feed port 17 is output to the other of the first feed port 15 and the second feed port 17, that is, to allow isolation to be higher (more favorable).

In this regard, the center of gravity CG1 of the ring-shaped conductor layer 13 in planar view from the direction of the layering theoretically has the reference potential of a high-frequency signal (zero potential in this example) on the assumption that the ring-shaped conductor layer 13 singly exists. However, since the ring-shaped conductor layer 13 does not singly exist in an actual state, a position having the reference potential is displaced from the center of gravity CG1. Therefore, the symmetry property in the XY plane of the potential of the ring-shaped conductor layer 13 is poor in the absence of the conductor pin 19. The poor symmetry property of the potential is considered to cause a reduction in isolation.

Thus, the position having the reference potential is fixed in the inner diameter of the ring-shaped conductor layer 13 by placing the conductor pin 19 in the inner diameter of the ring-shaped conductor layer 13 in planar view from the direction of the layering, and by connecting the conductor pin 19 to the reference potential conductor layer 18 in Embodiment 1. As a result, the symmetry property in the XY plane of the potential of the ring-shaped conductor layer 13 is considered to be improved to enable an increase in isolation in the operating frequency band of the dual polarized antenna 100.

It will now be investigated whether or not isolation can be increased by connecting, to the reference potential conductor layer 18, the conductor pin 19 placed in the inner diameter of the ring-shaped conductor layer 13 in planar view from the direction of the layering when the dual polarized antenna 100 in Embodiment 1 is produced under the following conditions.

First, the lengths $W_x$ and $W_y$ in the X- and Y-axis directions of each of the first dielectric layer 11 illustrated in FIG. 1B and the second dielectric layer 12 illustrated in FIG. 1C are set at 40 [mm]. The width $W_1$ of the ring-shaped conductor layer 13 is set at 2.7 [mm], the external radius a of the ring-shaped conductor layer 13 is set at 8.0 [mm], and the internal radius b of the ring-shaped conductor layer 13 is set at 5.3 [mm]. The diameter $D_2$ of the conductor pin 19 is set at 2.5 [mm]. The longitudinal lengths $P_L$ of the first feedline 14 and the second feedline 16 are set at 9.6 [mm], and the lateral lengths $P_w$ of the first feedline 14 and the second feedline 16 are set at 3.0 [mm]. Distances $P_0$ from the center of gravity of the conductor pin 19 in planar view from the direction of the layering to the first feedline 14 and the second feedline 16 are set at 3.53 [mm].

The thickness $t_1$ of the first dielectric layer 11 is set at 2.40 [mm], and the thickness $t_2$ of the second dielectric layer 12 is set at 4.80 [mm]. The relative permittivities $\varepsilon_r$ of the first dielectric layer 11 and the second dielectric layer 12 are set at 2.6. The diameters $D_1$ of the first feed port 15 and the second feed port 17 are set at 1.20 [mm]. A distance $P_{s1}$ from the center of gravity of the first feed port 15 to the outer edge of the ring-shaped conductor layer 13 in planar view from the direction of the layering is set at 1.9 [mm], and a distance $P_{s2}$ from the center of gravity of the first feed port 15 to the end in the −Y-axis direction of the first feedline 14 is set at 3.3 [mm]. In planar view from the direction of the layering, a distance $P_{s1}$ from the center of gravity of the second feed port 17 to the outer edge of the ring-shaped conductor layer 13 is set at 1.9 [mm], and a distance $P_{s2}$ from the center of gravity of the second feed port 17 to the end in the +X-axis direction of the second feedline 16 is set at 3.3 [mm].

Figure 2A:
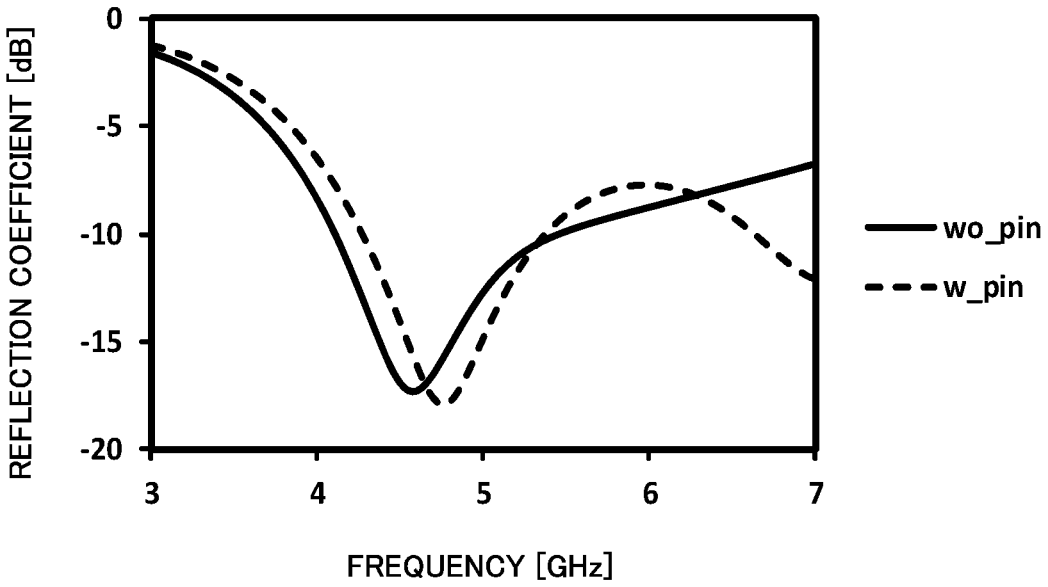
FIG. 2A is a view illustrating the reflection characteristics of the antenna according to Embodiment 1.
Figure 2B:
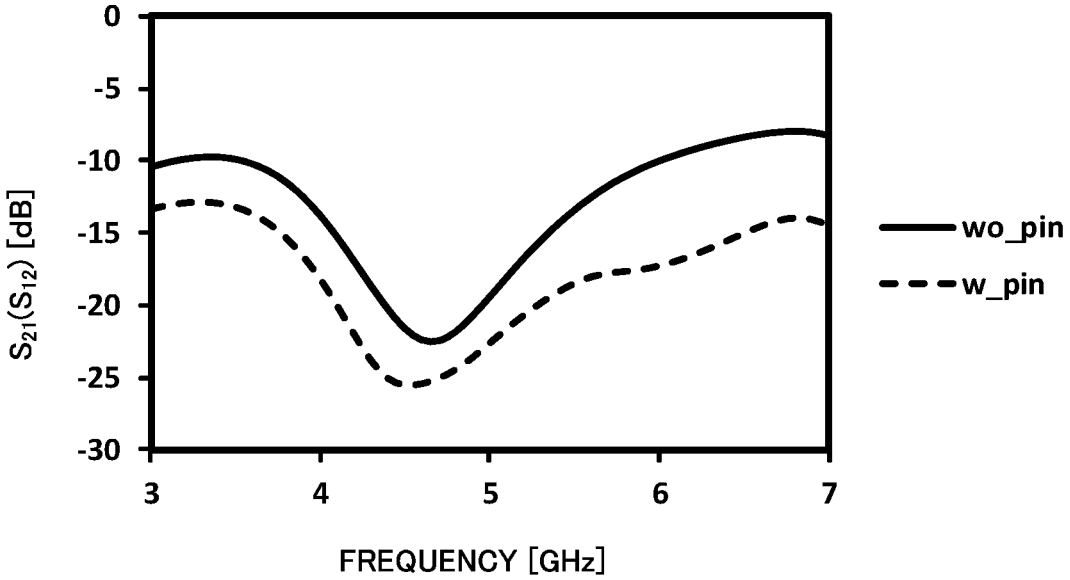
FIG. 2B is a view illustrating the isolation characteristics of the antenna according to Embodiment 1.

Reflection and isolation characteristics in the case of forming the dual polarized antenna 100 under the conditions described above are illustrated in FIGS. 2A and 2B. FIG. 2A is a view illustrating the reflection characteristics in the dual polarized antenna 100. FIG. 2B is a view illustrating the isolation characteristics between the first feed port 15 and the second feed port 17. In FIGS. 2A and 2B, the continuous lines indicate a case in which the conductor pin 19 is not placed, and the dashed lines indicate a case in which the conductor pin 19 is placed.

Commonly, the operating frequency band of the dual polarized antenna 100 is a frequency band in which a reflection coefficient is −10 [dB] or less. In FIG. 2A, the frequency in which the reflection coefficient is −10 [dB] is between about 4 [GHz] and 5 [GHz]. Accordingly, the operating frequency band of the dual polarized antenna 100 includes a frequency of between about 4 [GHz] and 5 [GHz].

In FIG. 2B, at a frequency of between about 4 [GHz] and 5 [GHz], values of $S_{21}$ and $S_{12}$ in a case in which the conductor pin 19 is placed are less than those in a case in which the conductor pin 19 is not placed. As described above, isolation can be increased in the operating frequency band of the dual polarized antenna 100 by placing the conductor pin 19 in the inner diameter of the ring-shaped conductor layer 13 in planar view from the direction of the layering, and by connecting the conductor pin 19 to the reference potential conductor layer 18.

As described above, in accordance with the dual polarized antenna 100 according to Embodiment 1, isolation in the operating frequency band of the dual polarized antenna 100 can be increased by placing the conductor pin 19 in the inner diameter of the ring-shaped conductor layer 13 in planar view from the direction of the layering, and by connecting the conductor pin 19 to the reference potential conductor layer 18. Accordingly, the dual polarized antenna 100 with favorable isolation characteristics can be obtained in the operating frequency band of the dual polarized antenna 100.

Embodiment 2

Figure 3A:
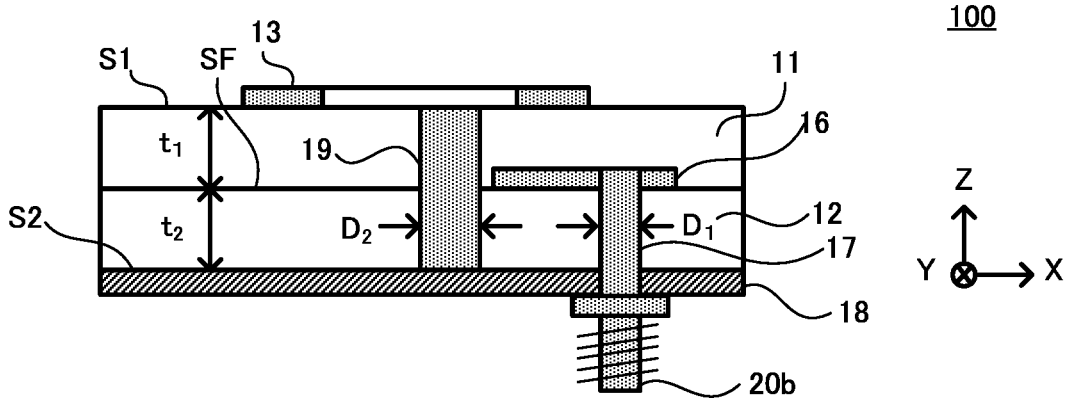
FIG. 3A is a cross-sectional view of an antenna according to Embodiment 2.
Figure 3B:
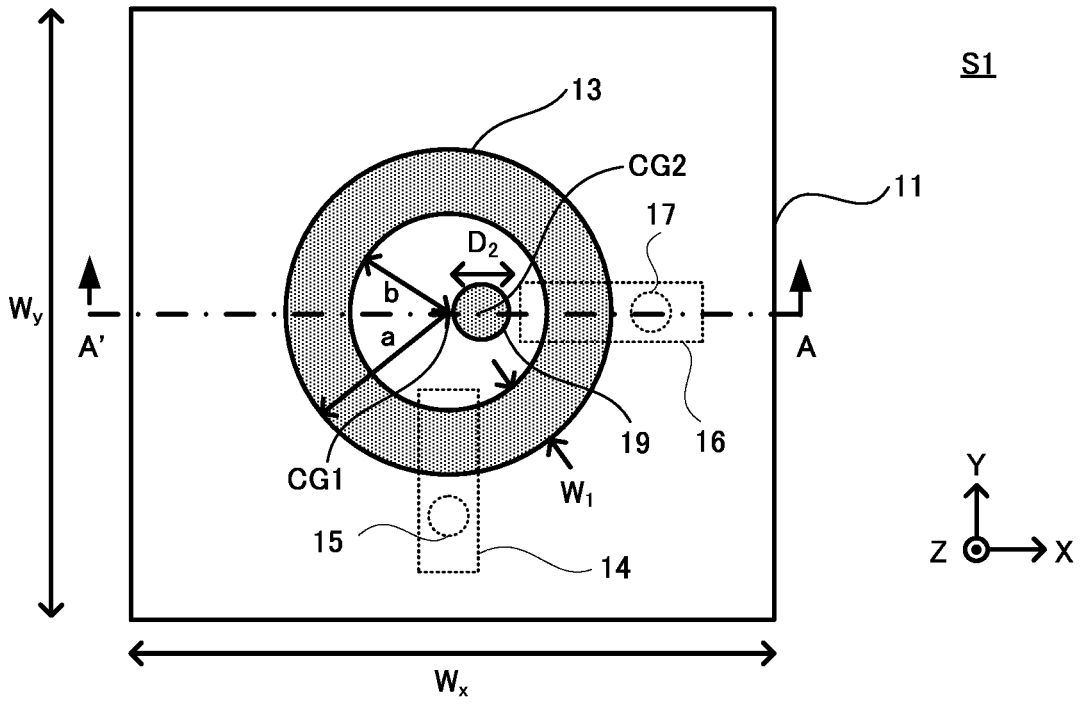
FIG. 3B is a plan view of a first surface of the antenna according to Embodiment 2.
Figure 3C:
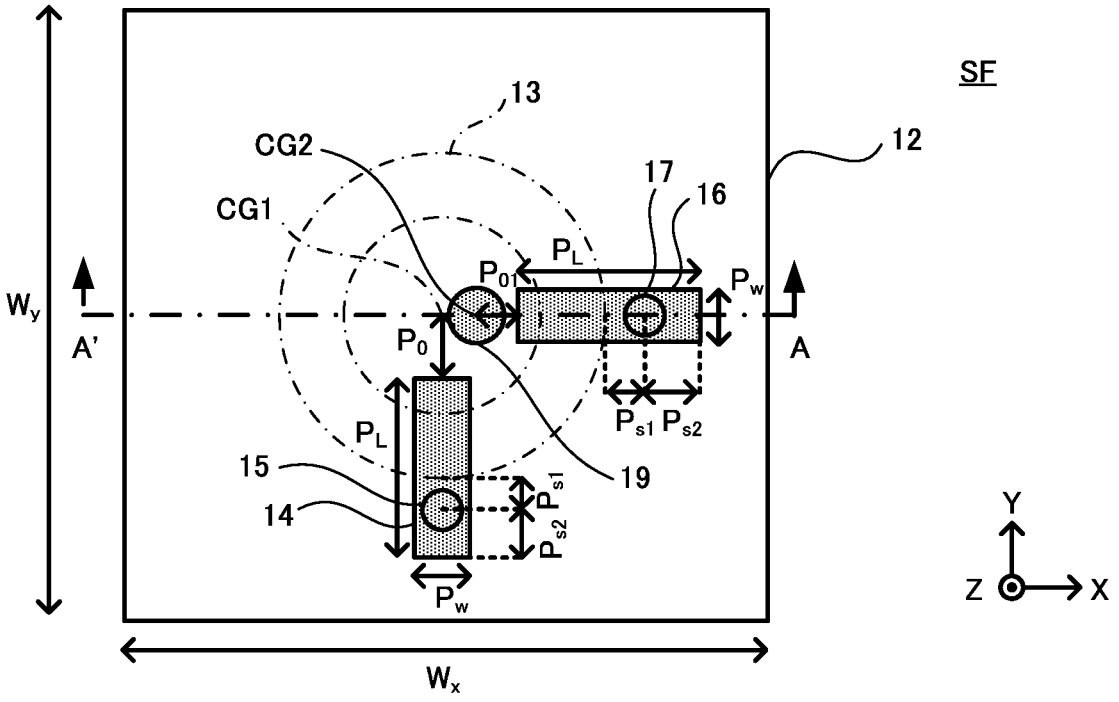
FIG. 3C is a plan view of a surface, on which feedlines are formed, of the antenna according to Embodiment 2.

In Embodiment 1, the conductor pin 19 is placed so that the center of gravity CG2 of the conductor pin 19 fits with the center of gravity CG1 of the ring-shaped conductor layer 13 in planar view from the direction of the layering. This disclosure is not limited thereto. In a dual polarized antenna 100 according to Embodiment 2, the center of gravity CG2 of a conductor pin 19 is horizontally moved in the +X-axis direction from the center of gravity CG1 of a ring-shaped conductor layer 13, to be closer to a second feedline 16, in planar view from the direction of layering, as illustrated in FIGS. 3A to 3C. Each configuration of the dual polarized antenna 100 illustrated in FIGS. 3A to 3C is similar to that of Embodiment 1 except the position of the conductor pin 19.

It will now be investigated whether or not isolation can be increased by placing the conductor pin 19 in the inner diameter of the ring-shaped conductor layer 13 in planar view from the direction of the layering, and by connecting the conductor pin 19 to the reference potential conductor layer 18, when the dual polarized antenna 100 in Embodiment 2 is produced under the following conditions.

A distance $P_{01}$ from the center of gravity CG2 of the conductor pin 19 to the second feedline 16 in planar view from the direction of the layering is set at 2.53 [mm]. The other configurations are similar to those of Embodiment 1.

Figure 4A:
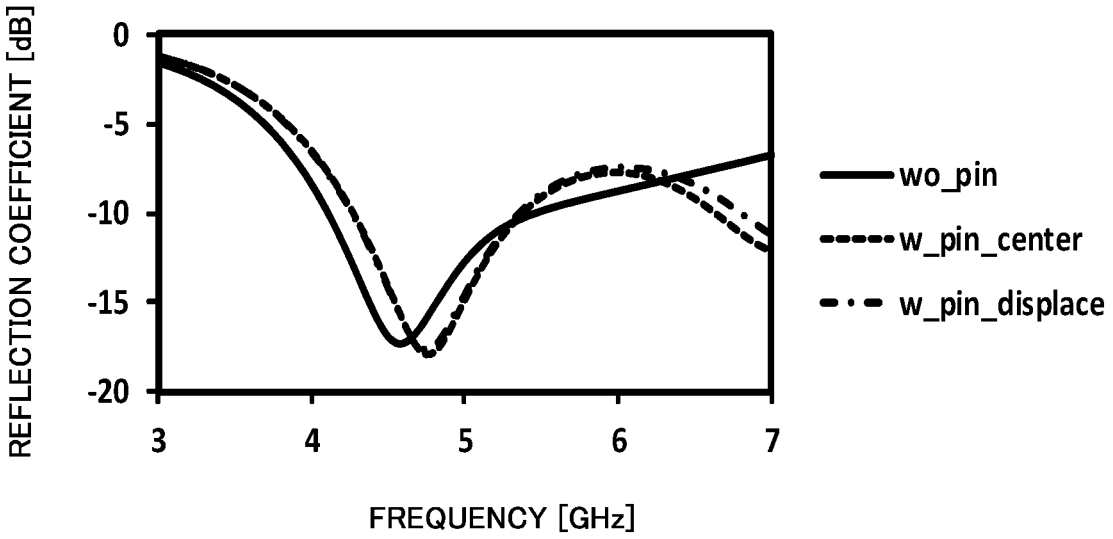
FIG. 4A is a view illustrating the reflection characteristics of the antenna according to Embodiment 2.
Figure 4B:
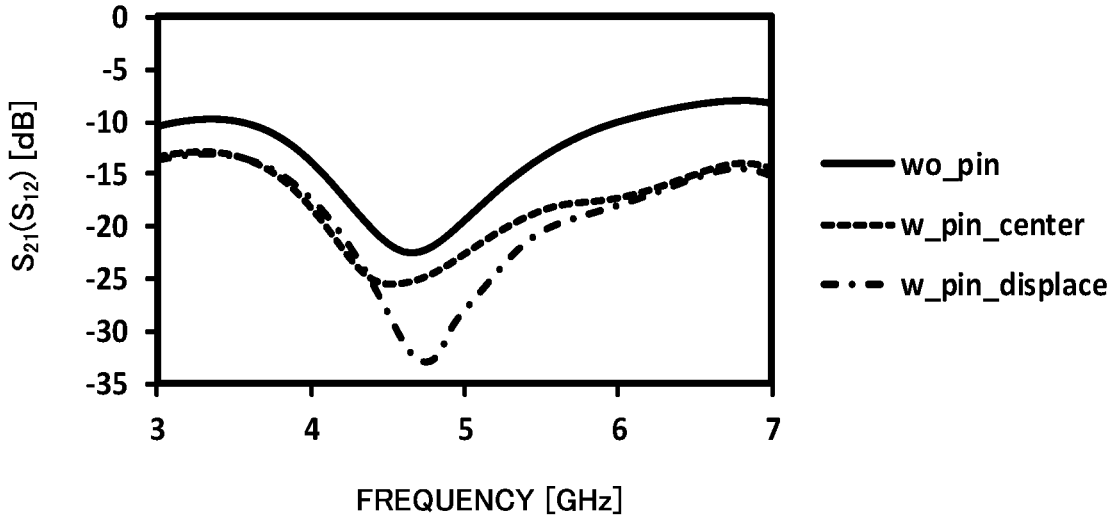
FIG. 4B is a view illustrating the isolation characteristics of the antenna according to Embodiment 2.

Reflection and isolation characteristics in the case of forming the dual polarized antenna 100 under the conditions described above are illustrated in FIGS. 4A and 4B. FIG. 4A is a view illustrating the reflection characteristics of the dual polarized antenna 100. FIG. 4B is a view illustrating the isolation characteristics between a first feed port 15 and a second feed port 17. In FIGS. 4A and 4B, the continuous lines indicate a case in which the conductor pin 19 is not placed. In FIGS. 4A and 4B, the dashed lines indicate a case in which the conductor pin 19 is placed so that the center of gravity CG2 of the conductor pin 19 fits with the center of gravity CG1 of the ring-shaped conductor layer 13 in planar view from the direction of the layering. In FIGS. 4A and 4B, the alternate long and short dash lines indicate a case in which the conductor pin 19 is placed so that the second feedline 16 is closer to the center of gravity CG2 of the conductor pin than to the center of gravity CG1 of the ring-shaped conductor layer 13 in planar view from the direction of the layering.

Commonly, the operating frequency band of the dual polarized antenna 100 is a frequency band in which a reflection coefficient is −10 [dB] or less. In FIG. 4A, the frequency in which the reflection coefficient is −10 [dB] is between about 4 [GHz] and 5 [GHz]. Accordingly, the operating frequency band of the dual polarized antenna 100 includes a frequency of between about 4 [GHz] and 5 [GHz].

In FIG. 4B, at a frequency of between about 4 [GHz] and 5 [GHz], values of $S_{21}$ and $S_{12}$ in a case in which the conductor pin 19 is placed are less than those in a case in which the conductor pin 19 is not placed. In particular, at a frequency of between about 4.3 [GHz] and 5 [GHz], values of $S_{21}$ and $S_{12}$ in a case in which the conductor pin 19 is placed so that the second feedline 16 is closer to the center of gravity CG2 of the conductor pin 19 than to the center of gravity CG1 of the ring-shaped conductor layer 13 are less than those in a case in which the conductor pin 19 is placed so that the center of gravity CG2 of the conductor pin 19 fits with the center of gravity CG1 of the ring-shaped conductor layer 13 in planar view from the direction of the layering. This is considered to be because the symmetry property of the potential of the whole dual polarized antenna 100 including not only the ring-shaped conductor layer 13 but also a first feedline 14, the second feedline 16, the first feed port 15, and the second feed port 17 is more favorable than that in the case in which the conductor pin 19 is placed so that the center of gravity CG2 of the conductor pin 19 fits with the center of gravity CG1 of the ring-shaped conductor layer 13 in planar view from the direction of the layering.

The example has been described in which the conductor pin 19 is placed so that the second feedline 16 is closer to the center of gravity CG2 of the conductor pin 19 than to the center of gravity CG1 of the ring-shaped conductor layer 13 in planar view from the direction of the layering. However, the same also applied to a case in which the conductor pin 19 is placed so that the first feedline 14 is closer to the center of gravity CG2 of the conductor pin 19 than to the center of gravity CG1 of the ring-shaped conductor layer 13 in planar view from the direction of the layering. Isolation can be increased in the operating frequency band of the dual polarized antenna 100 even when the conductor pin 19 is placed so that the center of gravity CG2 of the conductor pin 19 is displaced from the center of gravity CG1 of the ring-shaped conductor layer 13 in planar view from the direction of the layering, and the conductor pin 19 is connected to the reference potential conductor layer 18, as described above.

Isolation can be increased in the operating frequency band of the dual polarized antenna 100 even when the conductor pin 19 is placed so that the center of gravity CG2 of the conductor pin 19 is displaced from the center of gravity CG1 of the ring-shaped conductor layer 13 in planar view from the direction of the layering, and the conductor pin 19 is connected to the reference potential conductor layer 18, as described above. Accordingly, the dual polarized antenna 100 with favorable isolation characteristics can be obtained in the operating frequency band of dual polarized antenna 100.

Embodiment 3

Examples of the configurations in which isolation is increased in the dual polarized antenna 100 with one operating frequency band are described in each of Embodiments 1 and 2. This disclosure is not limited thereto. In Embodiment 3, configurations are described in which isolation is increased in a dual polarized antenna 100A with a plurality of operating frequency bands.

Figure 5A:
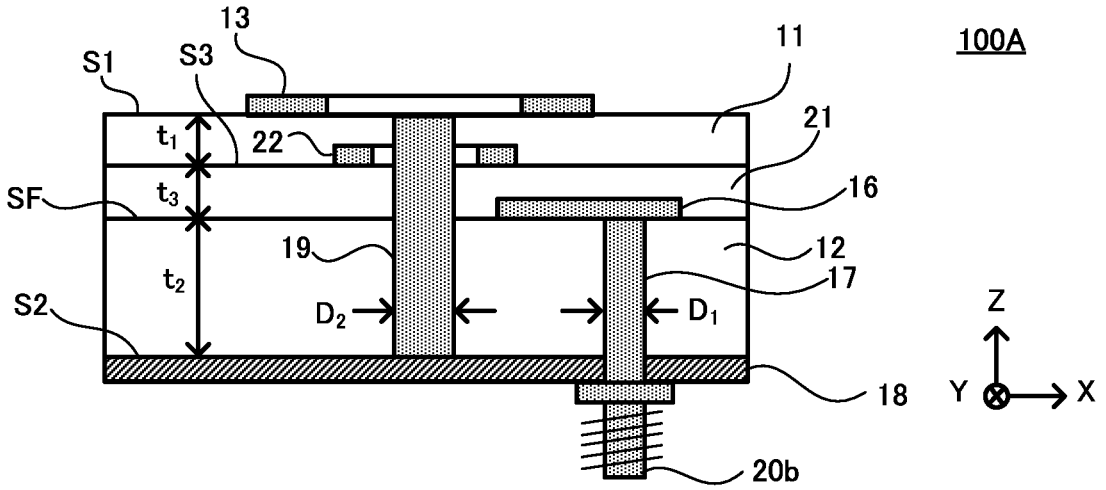
FIG. 5A is a cross-sectional view of an antenna according to Embodiment 3.
Figure 5B:
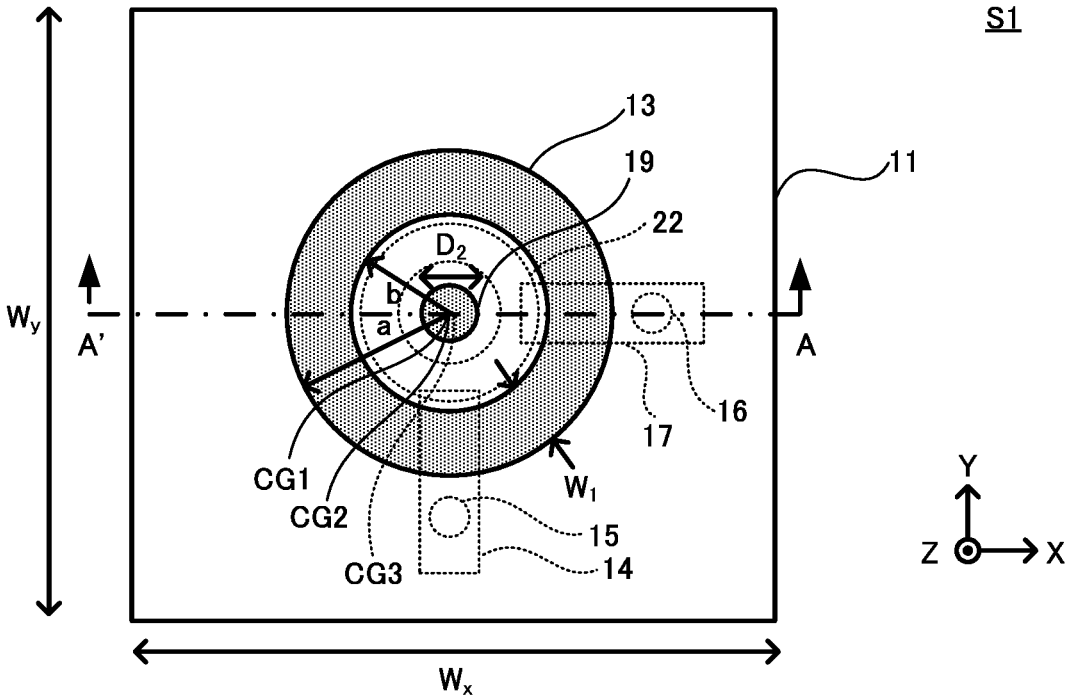
FIG. 5B is a plan view of a first surface of the antenna according to Embodiment 3.
Figure 5C:
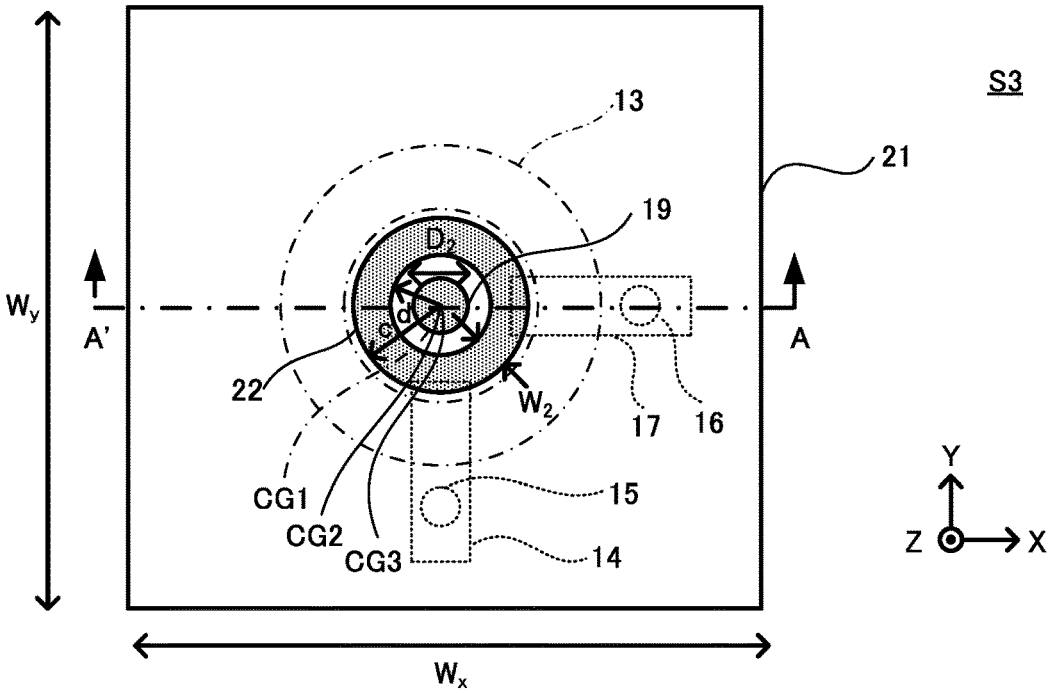
FIG. 5C is a plan view of a third surface of the antenna according to Embodiment 3.
Figure 5D:
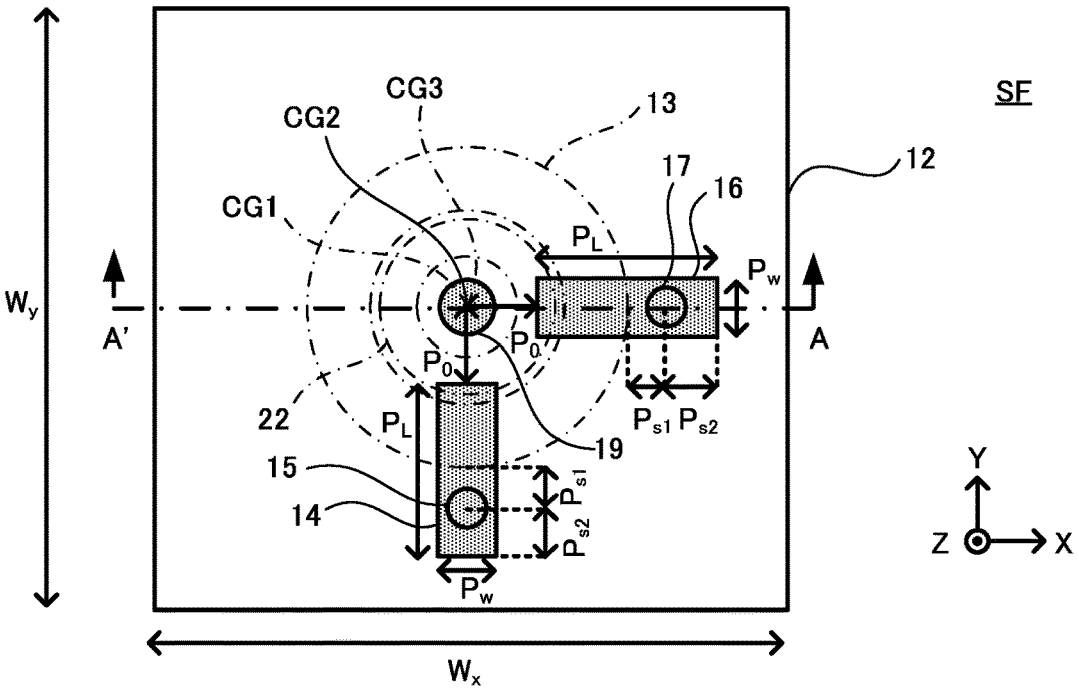
FIG. 5D is a plan view of a surface, on which feedlines are formed, of the antenna according to Embodiment 3.

The configurations of the dual polarized antenna 100A according to Embodiment 3 are illustrated in FIGS. 5A to 5D. FIG. 5A is a cross-sectional view of the dual polarized antenna 100A. FIG. 5B is a plan view of a first surface S1. FIG. 5C is a plan view of a third surface S3. FIG. 5D is a plan view of a surface SF on which feedlines are formed. The cross-sectional view of FIG. 5A corresponds to a cross-sectional view taken along the arrow A-A' in FIGS. 5B to 5D.

As illustrated in FIGS. 5A to 5D, the dual polarized antenna 100A includes a first dielectric layer 11, a second dielectric layer 12, a ring-shaped conductor layer 13, a first feedline 14, a second feedline 16, a first feed port 15, a second feed port 17, a reference potential conductor layer 18, a conductor pin 19, a third dielectric layer 21, and a small-sized ring-shaped conductor layer 22.

Like the first dielectric layer 11 and the second dielectric layer 12, the third dielectric layer 21 is formed in a flat plate shape. The first dielectric layer 11, the second dielectric layer 12, and the third dielectric layer 21 are layered to form a dielectric layer that supports the whole dual polarized antenna 100A. The third dielectric layer 21 has a thickness $t_3$, and has the same rectangular external shape as those of the first dielectric layer 11 and the second dielectric layer 12 in planar view from the direction of layering. The third dielectric layer 21 is formed of a dielectric material such as, for example, Teflon (registered trademark), ceramic, or epoxy resin.

In the dual polarized antenna 100A illustrated in FIGS. 5A to 5D, a principal surface in the +Z-axis direction of the third dielectric layer 21, coming in contact with the first dielectric layer 11, is referred to as the third surface S3. The third surface S3 is a surface different from the first surface S1, a second surface S2, and the surface SF on which the feedlines are formed. The third surface S3 is located at a position closer to the first surface S1 than to the second surface S2. In the present embodiment, the first dielectric layer 11, the second dielectric layer 12, and the third dielectric layer 21 are layered as described above. Therefore, the first surface S1 as a principal surface in the +Z-axis direction of the first dielectric layer 11, the third surface S3, the surface SF on which the feedlines are formed, as a principal surface in the +Z-axis direction of the second dielectric layer 12, coming in contact with the third dielectric layer 21, and the second surface S2 as a principal surface in the −Z-axis-direction of the second dielectric layer 12 in the order mentioned above are placed in layering.

The small-sized ring-shaped conductor layer 22 is a radiating element for transmitting and receiving third and fourth polarized waves of which the frequency bands are different from the frequency band of the ring-shaped conductor layer 13 illustrated in FIG. 5B. The small-sized ring-shaped conductor layer 22 is formed in a ring shape, obtained by hollowing out the central portion of a circle in planar view from the direction of the layering, and has inner and outer diameters different from the inner and outer diameters of the ring-shaped conductor layer 13. The small-sized ring-shaped conductor layer 22 is formed on the third surface S3 of the third dielectric layer 21.

In Embodiment 3, the center of gravity CG1 of the ring-shaped conductor layer 13 and the center of gravity CG3 of the small-sized ring-shaped conductor layer 22 fit with each other in planar view from the direction of the layering.

As illustrated in FIGS. 5B to 5D, each of the first feedline 14 and the second feedline 16 includes a portion overlapping with the small-sized ring-shaped conductor layer 22 in planar view from the direction of the layering. By the first dielectric layer 11, the second dielectric layer 12, and the third dielectric layer 21, the small-sized ring-shaped conductor layer 22 is insulated from the reference potential conductor layer 18 and the conductor pin 19, and is prevented from being connected to the reference potential conductor layer 18 and the conductor pin 19. The small-sized ring-shaped conductor layer 22 includes a conductor film, foil, or plate, or the like, and is formed of a conductor, for example, copper, gold, aluminum, or the like.

The conductor pin 19 passes through a through-hole formed in the first dielectric layer 11, the second dielectric layer 12, and the third dielectric layer 21. One end of the conductor pin 19 is connected to the reference potential conductor layer 18, and the other end of the conductor pin 19 is located in the center position of the ring-shaped conductor layer 13 on the first surface S1 of the first dielectric layer 11. Since the conductor pin 19 is connected to the reference potential conductor layer 18, the potential of the conductor pin 19 is equal to a reference potential, and the potential of the center position of the small-sized ring-shaped conductor layer 22 is close to the reference potential. The conductor pin 19 is formed in a columnar or cylindrical shape. The conductor pin 19 extends in the Z-axis direction, and is placed so that the center of gravity CG2 of the conductor pin 19 fits with the central portion of the inner diameter of the small-sized ring-shaped conductor layer 22, that is, the center of gravity CG1 of the ring-shaped conductor layer 13 and the center of gravity CG3 of the small-sized ring-shaped conductor layer 22, in planar view from the direction of the layering.

The above-described configurations other than the small-sized ring-shaped conductor layer 22 are similar to those of Embodiment 1.

The first dielectric layer 11, the second dielectric layer 12, and the third dielectric layer 21 may be separately or integrally formed.

Operation of the dual polarized antenna 100A including the above-described configurations will now be described. During transmission operation, first and second high-frequency signals to be transmitted (the signals themselves may be identical) are independently fed to the first feed port 15 and the second feed port 17. The first high-frequency signal is fed to the ring-shaped conductor layer 13 through the first feed port 15 and the first feedline 14. The second high-frequency signal is fed to the ring-shaped conductor layer 13 through the second feed port 17 and the second feedline 16. The first and second high-frequency signals are fed to the ring-shaped conductor layer 13, from the directions of the first and second high-frequency signals, orthogonal to each other, and therefore, the ring-shaped conductor layer 13 radiates first and second polarized waves of which the principal polarization planes are orthogonal to each other.

Third and fourth high-frequency signals (the signals themselves may be identical), of which the frequencies are different from those of the first and second high-frequency signals to be transmitted, are independently fed to the first feed port 15 and the second feed port 17. The third high-frequency signal is fed to the small-sized ring-shaped conductor layer 22 through the first feed port 15 and the first feedline 14. The fourth high-frequency signal is fed to the small-sized ring-shaped conductor layer 22 through the second feed port 17 and the second feedline 16. The third and fourth high-frequency signals are fed to the small-sized ring-shaped conductor layer 22, from the directions of the third and fourth high-frequency signals, orthogonal to each other, and therefore, the small-sized ring-shaped conductor layer 22 radiates third and fourth polarized waves of which the principal polarization planes are orthogonal to each other.

During reception operation, the first and second polarized waves reaching the dual polarized antenna 100A are received by the ring-shaped conductor layer 13. The first polarized wave is output from the first feed port 15 through the first feedline 14, and the second polarized wave is output from the second feed port 17 through the second feedline 16.

The third and fourth polarized waves reaching the dual polarized antenna 100A are received by the small-sized ring-shaped conductor layer 22. The third polarized wave is output from the first feed port 15 through the first feedline 14, and the fourth polarized wave is output from the second feed port 17 through the second feedline 16.

For favorably transmitting and receiving first, second, third, and fourth high-frequency signals in the dual polarized antenna 100A, it is necessary to decrease a value of $S_{21}$ or $S_{12}$ which is an S-parameter representing a degree (dB) at which a high-frequency signal fed to one of the first feed port 15 and the second feed port 17 is output to the other of the first feed port 15 and the second feed port 17, that is, to allow isolation to be higher (more favorable).

In this regard, the center of gravity CG3 of the small-sized ring-shaped conductor layer 22 in planar view from the direction of the layering theoretically has the reference potential of a high-frequency signal (zero potential in this example) on the assumption that the small-sized ring-shaped conductor layer 22 singly exists. However, since the small-sized ring-shaped conductor layer 22 does not singly exist in an actual state, a position having the reference potential is displaced from the center of gravity CG3. Therefore, the symmetry property in the XY plane of the potential of the small-sized ring-shaped conductor layer 22 is poor in the absence of the conductor pin 19. The poor symmetry property of the potential is considered to cause a reduction in isolation.

Thus, the position having the reference potential is fixed in the inner diameters of the ring-shaped conductor layer 13 and the small-sized ring-shaped conductor layer 22 by placing the conductor pin 19 in the inner diameter of the small-sized ring-shaped conductor layer 22 in planar view from the direction of the layering, and by connecting the conductor pin 19 to the reference potential conductor layer 18 in Embodiment 3. As a result, the symmetry properties in the XY plane of the potentials of the ring-shaped conductor layer 13 and the small-sized ring-shaped conductor layer 22 are considered to be improved to enable an increase in isolation in the operating frequency band of the dual polarized antenna 100A.

The first dielectric layer 11, the second dielectric layer 12, and the third dielectric layer 21 are examples of the dielectric layer in the claims. The ring-shaped conductor layer 13 is an example of the first ring-shaped conductor layer in the claims, and the small-sized ring-shaped conductor layer 22 is an example of the second ring-shaped conductor layer in the claims.

It will now be investigated whether or not isolation can be increased by placing the conductor pin 19 in the inner diameter of the small-sized ring-shaped conductor layer 22 in planar view from the direction of the layering, and by connecting the conductor pin 19 to the reference potential conductor layer 18 when the dual polarized antenna 100A in Embodiment 3 is produced under the following conditions.

The width $W_2$ of the small-sized ring-shaped conductor layer 22 is set at 1.45 [mm]. The external radius c of the small-sized ring-shaped conductor layer 22 is set at 5.05 [mm], and the internal radius d of the small-sized ring-shaped conductor layer 22 is set at 3.6 [mm]. The thickness $t_1$ of the first dielectric layer 11 and the thickness $t_3$ of the third dielectric layer 21 are set at 1.20 [mm], and the thickness $t_2$ of the second dielectric layer 12 is set at 4.80

[mm]. The relative permittivity $\varepsilon_r$ of the third dielectric layer 21 is set at 2.6. The other configurations are similar to those of Embodiment 1.

Figure 6A:
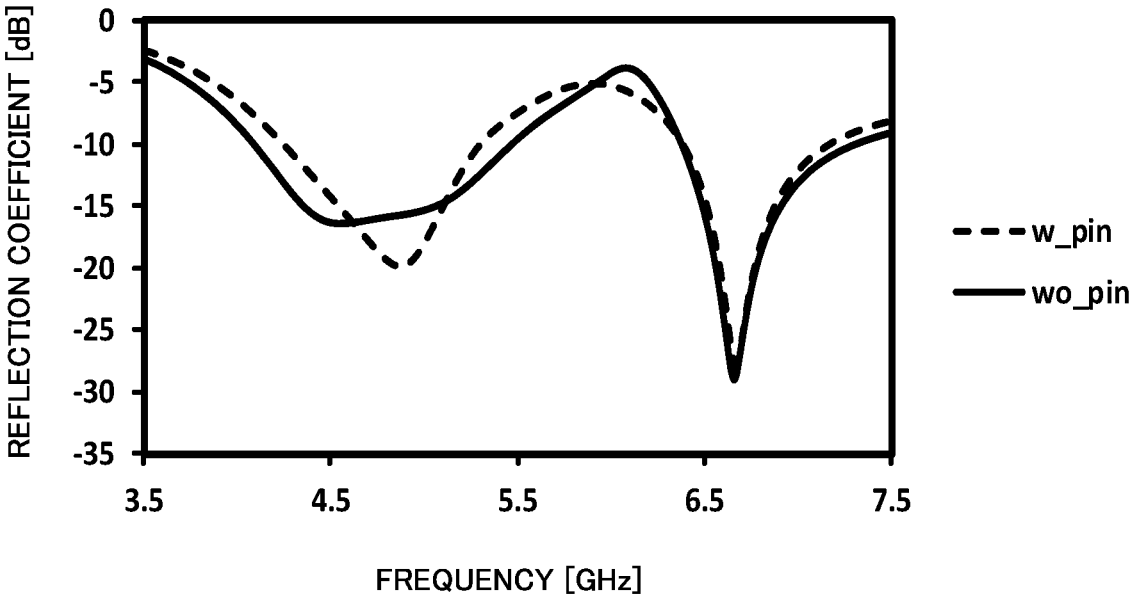
FIG. 6A is a view illustrating the reflection characteristics of the antenna according to Embodiment 3.
Figure 6B:
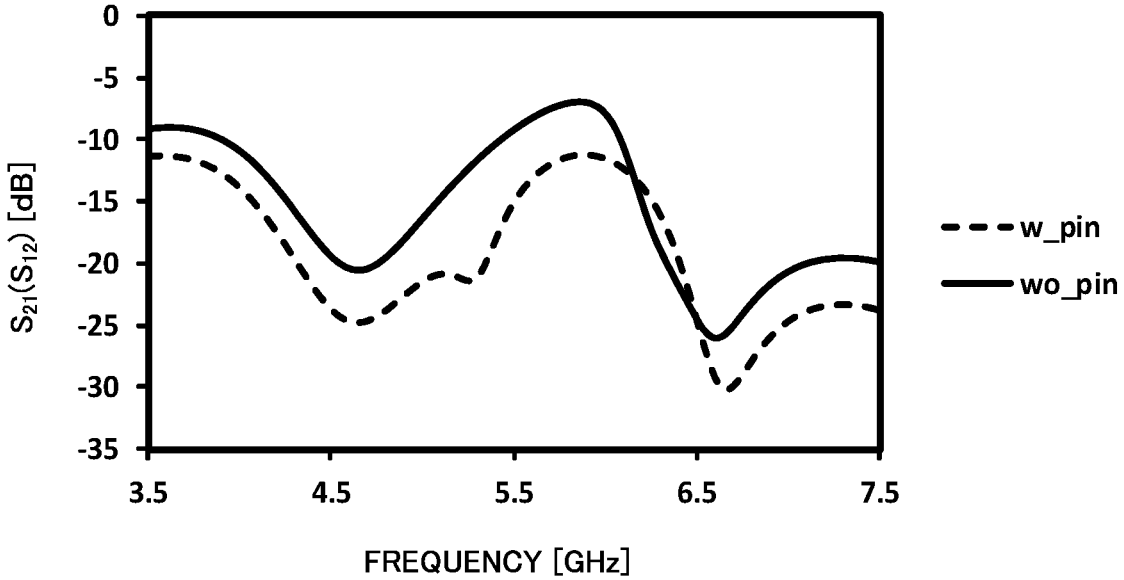
FIG. 6B is a view illustrating the isolation characteristics of the antenna according to Embodiment 3.
Figure 7A:
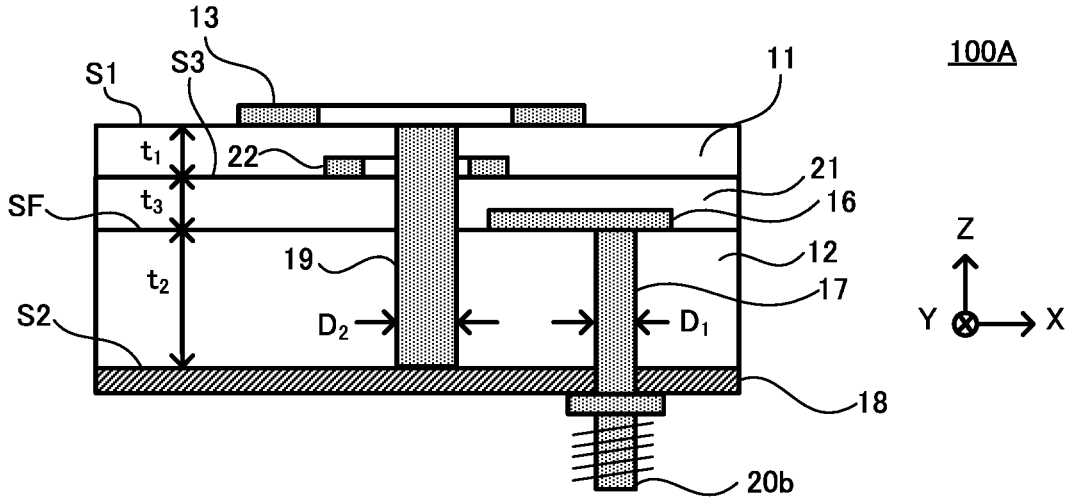
FIG. 7A is a cross-sectional view of an antenna according to Embodiment 4.
Figure 7B:
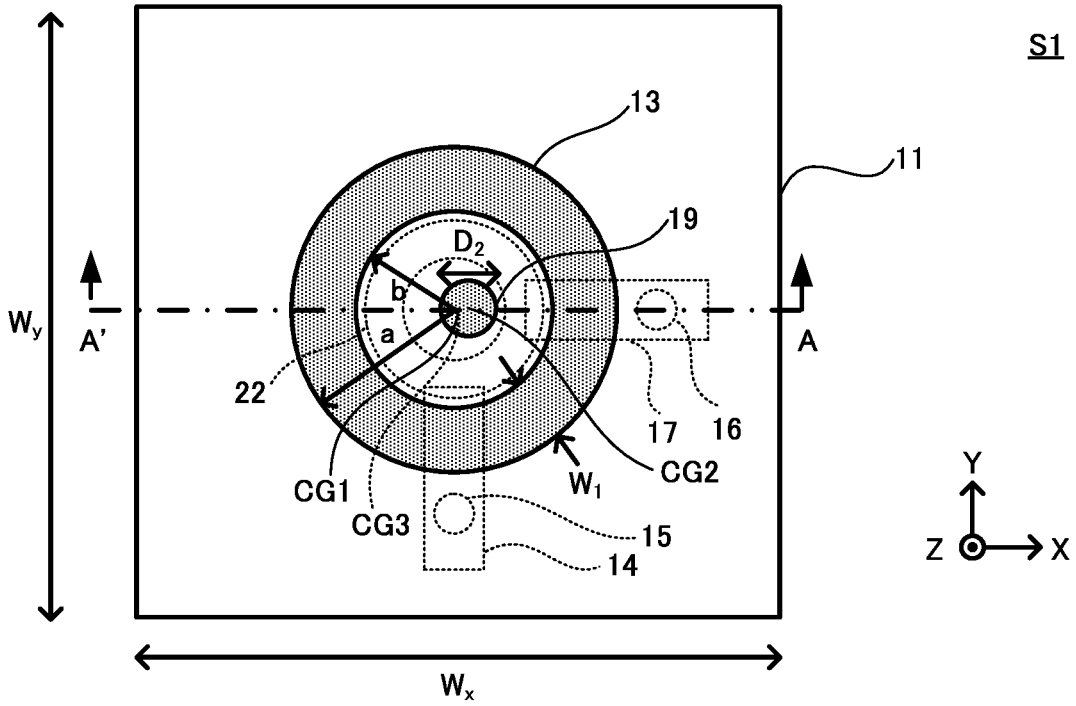
FIG. 7B is a plan view of a first surface of the antenna according to Embodiment 4.
Figure 7C:
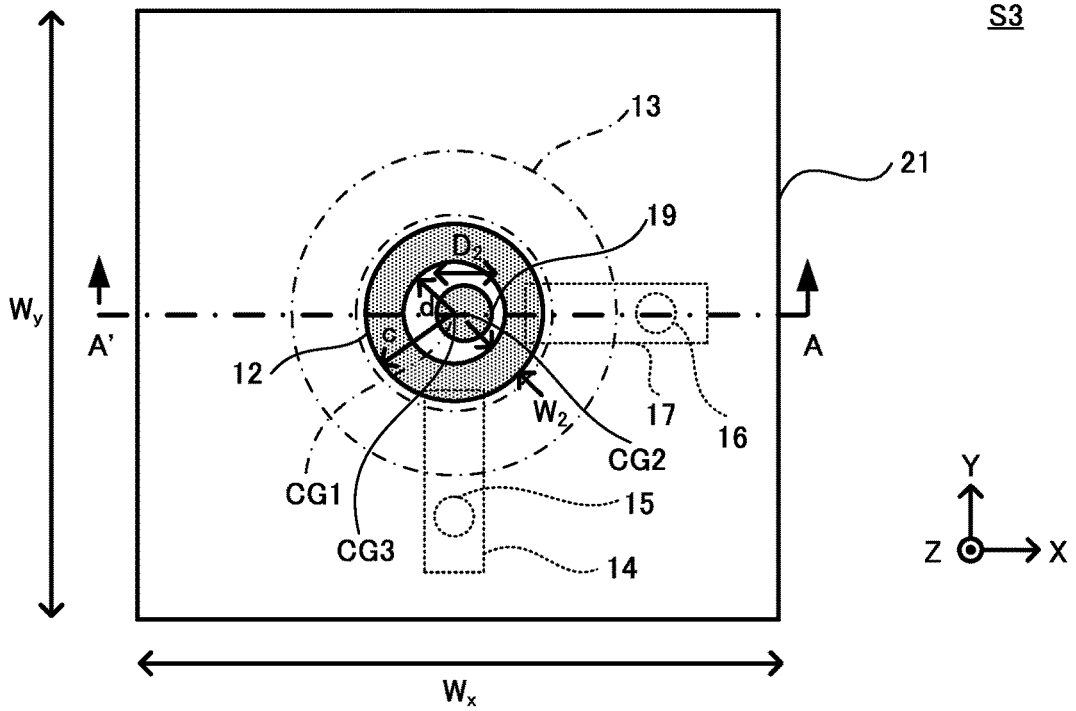
FIG. 7C is a plan view of a third surface of the antenna according to Embodiment 4.
Figure 7D:
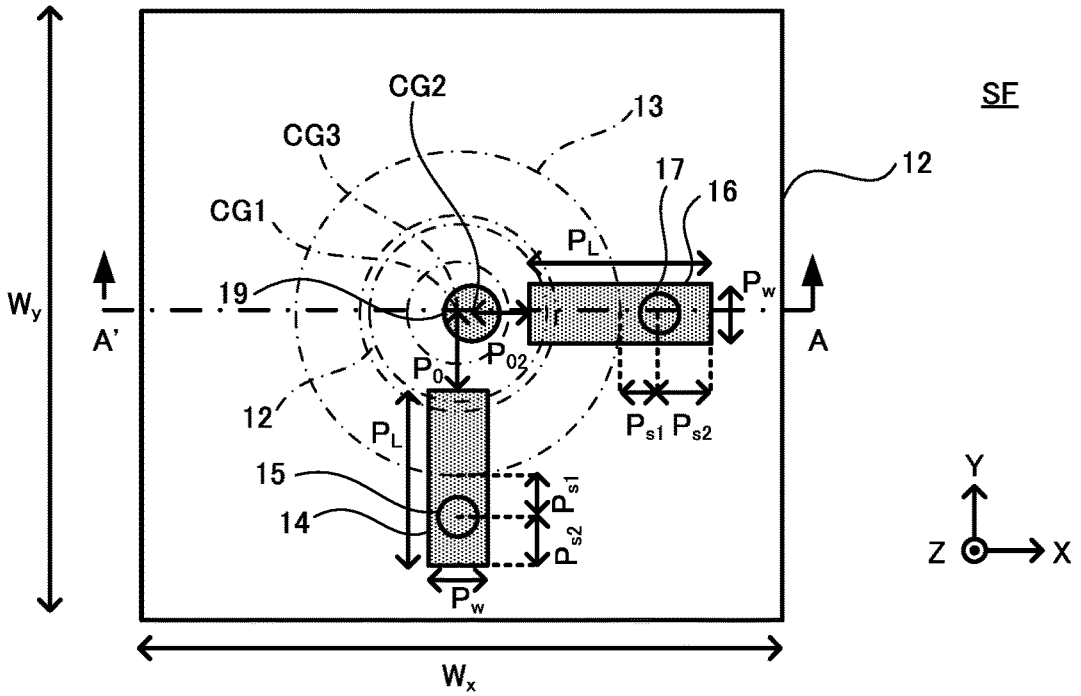
FIG. 7D is a plan view of a surface, on which feedlines are formed, of the antenna according to Embodiment 4.

Reflection and isolation characteristics in the case of forming the dual polarized antenna 100A under the conditions described above are illustrated in FIGS. 6A and 6B. FIG. 6A is a view illustrating the reflection characteristics in the dual polarized antenna 100A. FIG. 6B is a view illustrating the isolation characteristics between the first feed port 15 and the second feed port 17. In FIGS. 6A and 6B, the continuous lines indicate a case in which the conductor pin 19 is not placed, and the dashed lines indicate a case in which the conductor pin 19 is placed.

Commonly, the operating frequency bands of the dual polarized antenna 100A are frequency bands in which a reflection coefficient is −10 [dB] or less. In FIG. 6A, the frequency in which the reflection coefficient is −10 [dB] is between about 4.2 [GHz] and 5.5 [GHz], and between about 6.4 [GHz] and 7 [GHz]. Accordingly, the operating frequency bands of the dual polarized antenna 100A include a frequency of between about 4.2 [GHz] and 5.5 [GHz], and a frequency of between about 6.4 [GHz] and 7 [GHz].

In FIG. 6B, at a frequency of between about 4.2 [GHz] and 5.5 [GHz], values of $S_{21}$ and $S_{12}$ in a case in which the conductor pin 19 is placed are less than those in a case in which the conductor pin 19 is not placed. At a frequency of between about 6.4 [GHz] and 7 [GHz], values of $S_{21}$ and $S_{12}$ in a case in which the conductor pin 19 is placed are less than those in a case in which the conductor pin 19 is not placed, in a frequency band of a frequency of approximately 6.5 [GHz] or more. As described above, isolation can be increased even in the plural operating frequency bands of the dual polarized antenna 100A by placing the conductor pin 19 in the inner diameters of the ring-shaped conductor layer 13 and the small-sized ring-shaped conductor layer 22 in planar view from the direction of the layering, and by connecting the conductor pin 19 to the reference potential conductor layer 18.

As described above, in accordance with the dual polarized antenna 100A according to Embodiment 3, the conductor pin 19 is placed in the inner diameters of the ring-shaped conductor layer 13 and the small-sized ring-shaped conductor layer 22 in planar view from the direction of the layering, and the conductor pin 19 is connected to the reference potential conductor layer 18. As a result, isolation in the plural operating frequency bands of the dual polarized antenna 100A can be increased. Accordingly, the dual polarized antenna 100A with favorable isolation characteristics can be obtained in the plural operating frequency bands of the dual polarized antenna 100A.

Embodiment 4

In Embodiment 3, the conductor pin 19 is placed so that the center of gravity CG2 of the conductor pin 19 fits with the center of gravity CG3 of the small-sized ring-shaped conductor layer 22 in planar view from the direction of the layering. This disclosure is not limited thereto. In a dual polarized antenna 100A according to Embodiment 4, a conductor pin 19 is horizontally moved in the +X-axis direction from the center of gravity CG3 of a small-sized ring-shaped conductor layer 22, to be closer to a second feedline 16, as illustrated in FIGS. 7A to 7D. Each configuration of the dual polarized antenna 100A illustrated in FIGS. 7A to 7D is similar to that of Embodiment 3 except the position of the conductor pin 19.

It will now be investigated whether or not isolation can be increased by placing the conductor pin 19 in the inner diameter of the small-sized ring-shaped conductor layer 22 in planar view from the direction of the layering, and by connecting the conductor pin 19 to the reference potential conductor layer 18, when the dual polarized antenna 100A in Embodiment 4 is produced under the following conditions.

A distance $P_{02}$ from the center of gravity of the conductor pin 19 to the second feedline 16 in planar view from the direction of the layering is set at 2.53 [mm]. The other configurations are similar to those of Embodiment 3.

Figure 8A:
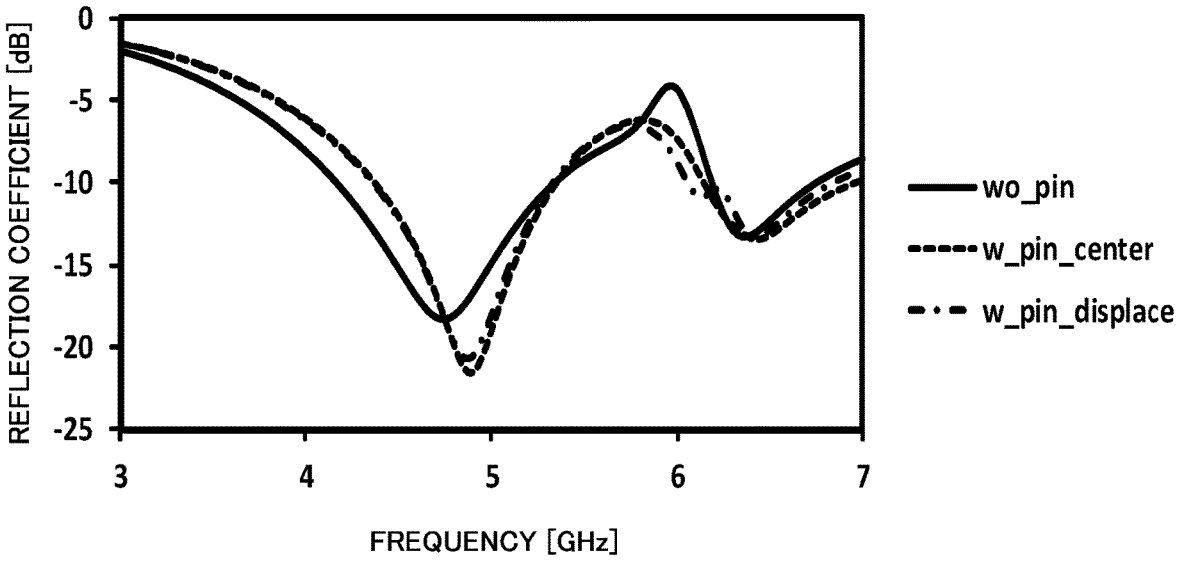
FIG. 8A is a view illustrating the reflection characteristics of the antenna according to Embodiment 4.
Figure 8B:
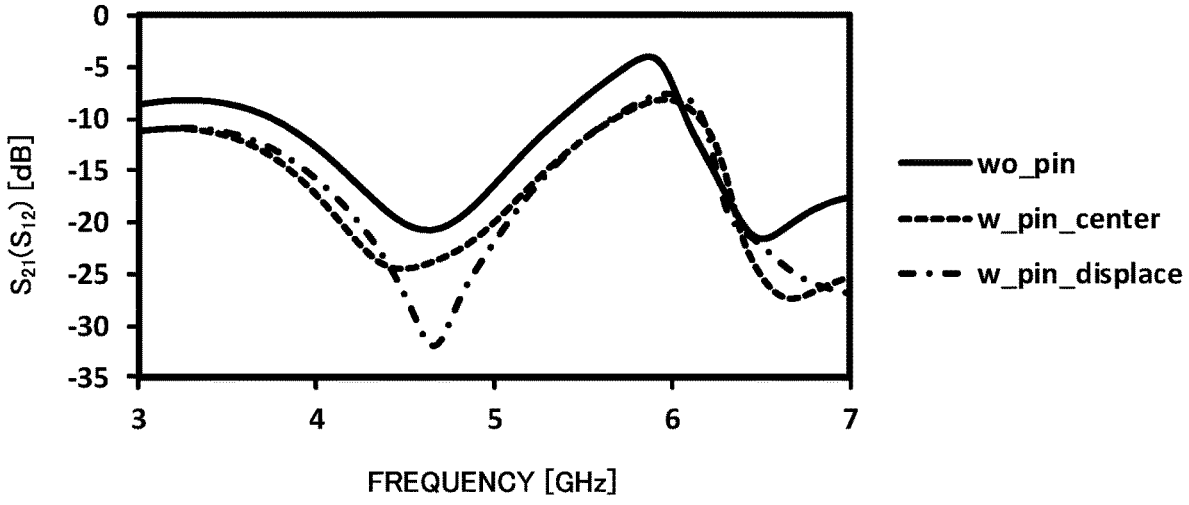
FIG. 8B is a view illustrating the isolation characteristics of the antenna according to Embodiment 4.

Reflection and isolation characteristics in the case of forming the dual polarized antenna 100A under the conditions described above are illustrated in FIGS. 8A and 8B. FIG. 8A is a view illustrating the reflection characteristics of the dual polarized antenna 100A. FIG. 8B is a view illustrating the isolation characteristics between a first feed port 15 and a second feed port 17. In FIGS. 8A and 8B, the continuous lines indicate a case in which the conductor pin 19 is not placed, the dashed lines indicate a case in which the conductor pin 19 is placed so that the center of gravity CG2 of the conductor pin 19 fits with the center of gravity CG3 of the small-sized ring-shaped conductor layer 22 in planar view from the direction of the layering, and the alternate long and short dash lines indicate a case in which the conductor pin 19 is placed so that the second feedline 16 is closer to the center of gravity CG2 of the conductor pin 19 than to the center of gravity CG3 of the small-sized ring-shaped conductor layer 22 in planar view from the direction of the layering.

Commonly, a reflection coefficient is −10 [dB] or less in the operating frequency bands of the dual polarized antenna 100A. In FIG. 8A, the frequencies in which the reflection coefficient is −10 [dB] is between about 4.2 [GHz] and 5.2 [GHz], and between about 6 [GHz] and about 7 [GHz]. Accordingly, the operating frequency bands of the dual polarized antenna 100A include a frequency of between about 4.2 [GHz] and 5.2 [GHz], and a frequency of between about 6 [GHz] and 7 [GHz].

In FIG. 8B, at a frequency of between about 4.2 [GHz] and 5.2 [GHz], values of $S_{21}$ and $S_{12}$ in a case in which the conductor pin 19 is placed are less than those in a case in which the conductor pin 19 is not placed. In particular, at a frequency of between about 4.5 [GHz] and 5 [GHz], values of $S_{21}$ and $S_{12}$ in a case in which the conductor pin 19 is placed so that the second feedline 16 is closer to the center of gravity CG2 of the conductor pin 19 than to the center of gravity CG1 of the ring-shaped conductor layer 13 are less than those in a case in which the conductor pin 19 is placed so that the center of gravity CG2 of the conductor pin 19 fits with the center of gravity CG1 of the ring-shaped conductor layer 13 in planar view from the direction of the layering.

At a frequency of between about 6 [GHz] and 7 [GHz], values of $S_{21}$ and $S_{12}$ in a case in which the conductor pin 19 is placed are less than those in a case in which the conductor pin 19 is not placed, at a frequency of 6.4 [GHz] or more. In particular, at a frequency of 6.5 [GHz] or more, values of $S_{21}$ and $S_{12}$ in a case in which the conductor pin 19 is placed so that the second feedline 16 is closer to the center of gravity CG2 of the conductor pin 19 than to the center of gravity CG3 of the small-sized ring-shaped conductor layer 22 in planar view from the direction of the layering are also less than those in a case in which the conductor pin 19 is not placed. Isolation can be increased in the operating frequency bands of the dual polarized antenna 100A even when the conductor pin 19 is placed so that the center of gravity CG2 of the conductor pin 19 is displaced from the center of gravity CG3 of the small-sized ring-shaped conductor layer 22 in planar view from the direction of the layering, and the conductor pin 19 is connected to the reference potential conductor layer 18, as described above.

In accordance with the dual polarized antenna 100A according to Embodiment 4, isolation in the operating frequency bands of the dual polarized antenna 100A can be increased even when the conductor pin 19 is placed so that the center of gravity CG2 of the conductor pin 19 is displaced from the center of gravity CG3 of the small-sized ring-shaped conductor layer 22 in planar view from the direction of the layering, and the conductor pin 19 is connected to the reference potential conductor layer 18, as described above. Accordingly, the dual polarized antenna 100A with favorable isolation characteristics can be obtained in the operating frequency bands of the dual polarized antenna 100A.

Embodiment 5

Examples of the configurations with the one conductor pin 19 have been described in Embodiments 1 to 4. This disclosure is not limited thereto. Configurations in which a plurality of pins of which the diameters are smaller than the diameter of the conductor pin 19 are used instead of the conductor pin 19 are described in Embodiment 5.

Figure 9A:
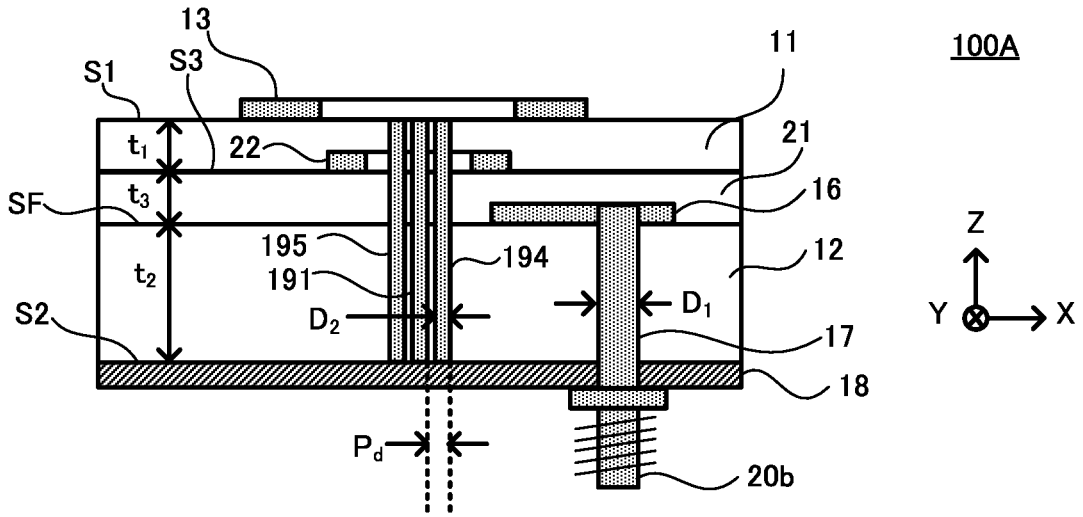
FIG. 9A is a cross-sectional view of an antenna according to Embodiment 5.
Figure 9B:
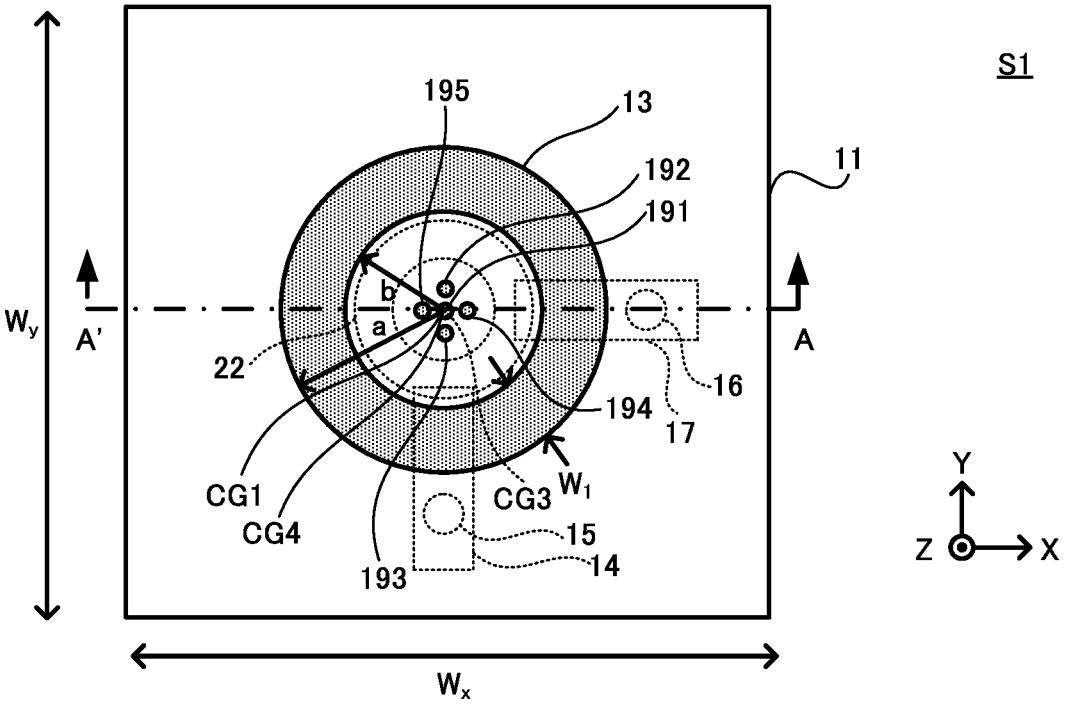
FIG. 9B is a plan view of a first surface of the antenna according to Embodiment 5.
Figure 9C:
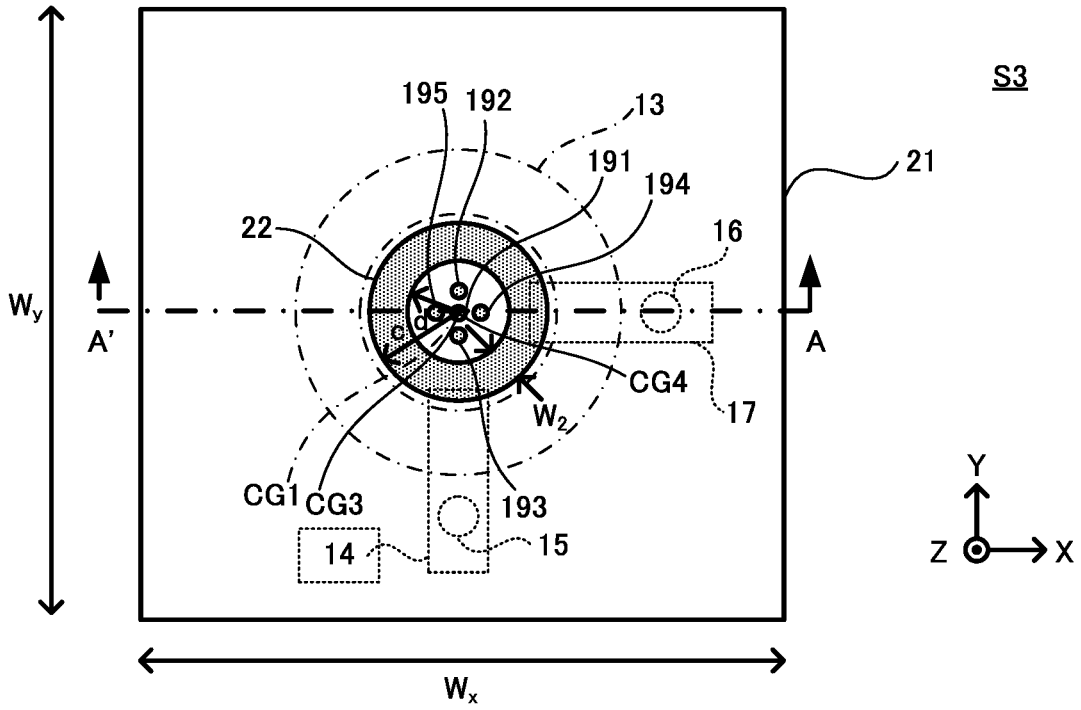
FIG. 9C is a plan view of a third surface of the antenna according to Embodiment 5.
Figure 9D:
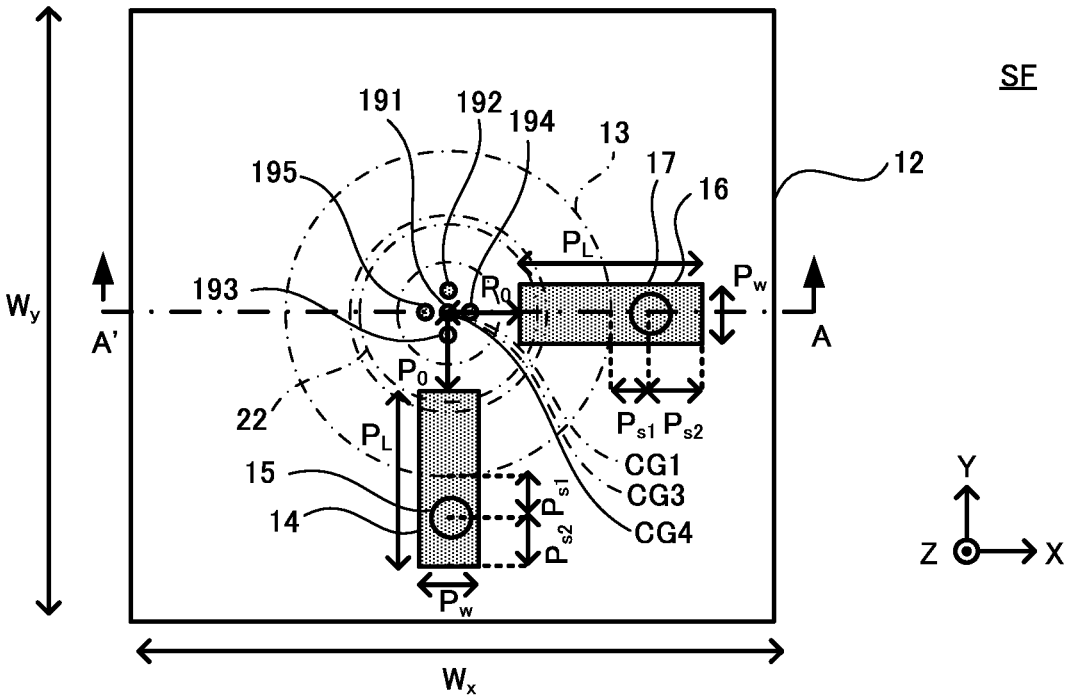
FIG. 9D is a plan view of a surface, on which feedlines are formed, of the antenna according to Embodiment 5.

The configurations of the dual polarized antenna 100A according to Embodiment 5 are illustrated in FIGS. 9A to 9D. FIG. 9A is a cross-sectional view of the dual polarized antenna 100A. FIG. 9B is a plan view of a first surface S1. FIG. 9C is a plan view of a third surface S3. FIG. 9D is a plan view of a surface SF on which feedlines are formed. The cross-sectional view of FIG. 9A corresponds to a cross-sectional view taken along the arrow A-A' in FIGS. 9B to 9D.

The dual polarized antenna 100A includes a first small-diameter conductor pin 191, a second small-diameter conductor pin 192, a third small-diameter conductor pin 193, a fourth small-diameter conductor pin 194, and a fifth small-diameter conductor pin 195. Each of the first to fifth small-diameter conductor pins 191 to 195 is formed in a columnar or cylindrical shape of which the diameter is smaller than those of the conductor pins 19 of which the examples are described in Embodiments 1 to 4.

The first to fifth small-diameter conductor pins 191 to 195 are pass through through-holes formed in the first dielectric layer 11, the second dielectric layer 12, and the third dielectric layer 21. One ends of the first to fifth small-diameter conductor pins 191 to 195 are connected to the reference potential conductor layer 18, and the other ends of the first to fifth small-diameter conductor pins 191 to 195 are located in the vicinity of the center of a ring-shaped conductor layer 13 on the first surface S1 of the first dielectric layer 11. Since the first to fifth small-diameter conductor pins 191 to 195 are connected to the reference potential conductor layer 18, the potentials of the first to fifth small-diameter conductor pins 191 to 195 are equal to a reference potential, and the potentials in the vicinities of the centers of the ring-shaped conductor layer 13 and a small-sized ring-shaped conductor layer 22 are close to the reference potential.

The first small-diameter conductor pin 191 extends in the Z-axis direction, and is placed so that the center of gravity CG4 of the first small-diameter conductor pin 191 fits with the central portions of the inner diameters of the ring-shaped conductor layer 13 and the small-sized ring-shaped conductor layer 22, that is, the center of gravity CG1 of the ring-shaped conductor layer 13 and the center of gravity CG3 of the small-sized ring-shaped conductor layer 22, in planar view from the direction of layering. The second small-diameter conductor pin 192 extends in the Z-axis direction, and is spaced at a fixed distance from the first small-diameter conductor pin 191 in the +Y-axis direction. The third small-diameter conductor pin 193 extends in the Z-axis direction, and is spaced at a fixed distance from the first small-diameter conductor pin 191 in the −Y-axis direction. The fourth small-diameter conductor pin 194 extends in the Z-axis direction, and is spaced at a fixed distance from the first small-diameter conductor pin 191 in the +X-axis direction. The fifth small-diameter conductor pin 195 extends in the Z-axis direction, and is spaced at a fixed distance from the first small-diameter conductor pin 191 in the −X-axis direction.

The second to fifth small-diameter conductor pins 192 to 195 are spaced at fixed distances from each other. Hereinafter, the first small-diameter conductor pin 191, the second small-diameter conductor pin 192, the third small-diameter conductor pin 193, the fourth small-diameter conductor pin 194, and the fifth small-diameter conductor pin 195 are collectively referred to as a small-diameter conductor pin 197. The other configurations are similar to those of Embodiment 3.

In Embodiment 5, the position having the reference potential can be fixed in the inner diameters of the ring-shaped conductor layer 13 and the small-sized ring-shaped conductor layer 22 by placing the small-diameter conductor pin 197 in the inner diameters of the ring-shaped conductor layer 13 and the small-sized ring-shaped conductor layer 22 in planar view from the direction of the layering, and by connecting the small-diameter conductor pin 197 to the reference potential conductor layer 18. As a result, like the conductor pins 19 described in Embodiments 1 to 4, the symmetry properties in the XY plane of the potentials of the ring-shaped conductor layer 13 and the small-sized ring-shaped conductor layer 22 are considered to be improved to enable an increase in isolation in the operating frequency band of the dual polarized antenna 100A.

It will now be investigated whether or not isolation can be increased by placing the small-diameter conductor pin 197 in the inner diameters of the ring-shaped conductor layer 13 and the small-sized ring-shaped conductor layer 22 in planar view from the direction of the layering, and by connecting the small-diameter conductor pin 197 to the reference potential conductor layer 18 when the dual polarized antenna 100A in Embodiment 5 is produced under the following conditions.

Each of the diameters $D_2$ of the first small-diameter conductor pin 191, the second small-diameter conductor pin 192, the third small-diameter conductor pin 193, the fourth small-diameter conductor pin 194, and the fifth small-diameter conductor pin 195 is set at 0.9 [mm]. A distance Pd between the end face in the +X-axis direction of the first small-diameter conductor pin 191 and the end face in the +X-axis direction of the fourth small-diameter conductor pin 194 is set at 1.35 [mm]. Likewise, each of distances Pd between the end face in the −X-axis direction of the first small-diameter conductor pin 191 and the end face in the −X-axis direction of the fifth small-diameter conductor pin 195, between the end face in the +Y-axis direction of the first small-diameter conductor pin 191 and the end face in the −Y-axis direction of the second small-diameter conductor pin 192, and between the end face in the −Y-axis direction of the first small-diameter conductor pin 191 and the end face in the +Y-axis direction of the second small-diameter conductor pin 192 is set at 1.35 [mm]. The other conditions are similar to those in Embodiment 3.

Figure 10A:
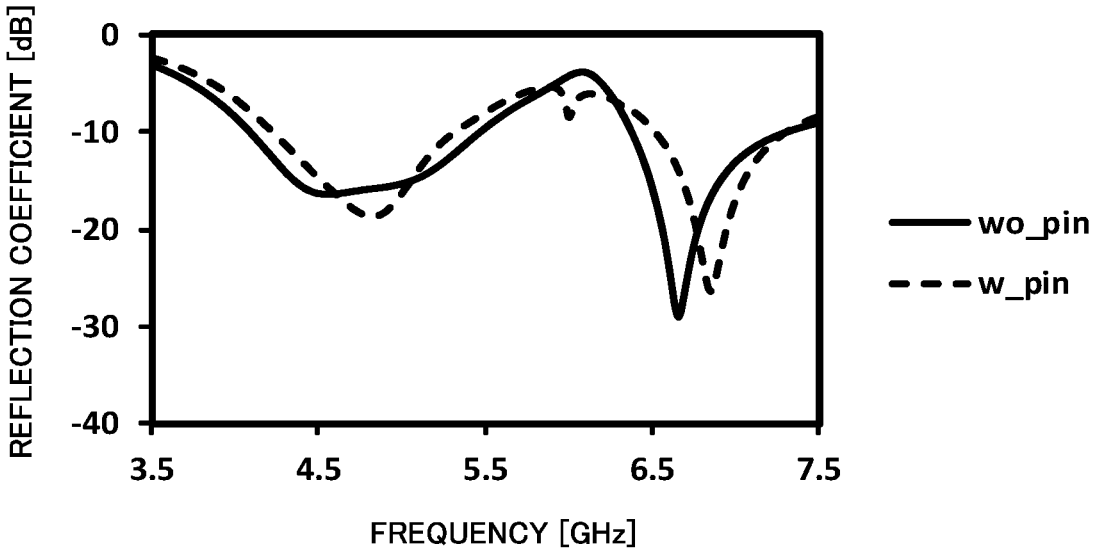
FIG. 10A is a view illustrating the reflection characteristics of the antenna according to Embodiment 5.
Figure 10B:
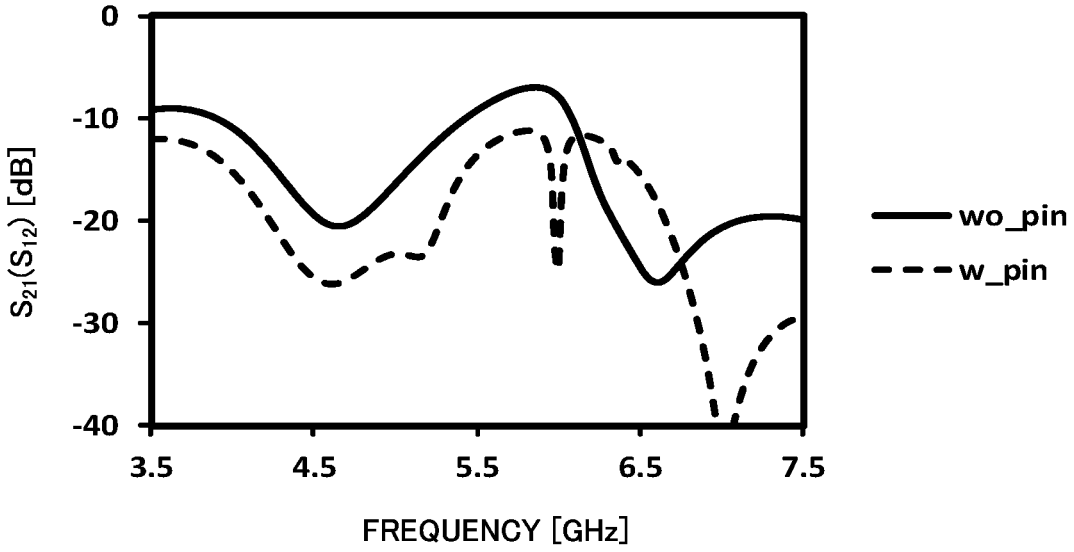
FIG. 10B is a view illustrating the isolation characteristics of the antenna according to Embodiment 5.

Reflection and isolation characteristics in the case of forming the dual polarized antenna 100A under the conditions described above are illustrated in FIGS. 10A and 10B. FIG. 10A is a view illustrating the reflection characteristics of the dual polarized antenna 100A. FIG. 10B is a view illustrating the isolation characteristics between a first feed port 15 and a second feed port 17. In FIGS. 10A and 10B, the continuous lines indicate a case in which the small-diameter conductor pin 197 is not placed, and the dashed lines indicate a case in which the small-diameter conductor pin 197 is placed.

Commonly, the operating frequency bands of the dual polarized antenna 100A are frequency bands in which a reflection coefficient is −10 [dB] or less. In FIG. 10A, the frequency in which the reflection coefficient is −10 [dB] is between about 4 [GHz] and 5 [GHz], and between about 6.4 [GHz] and 7 [GHz]. Accordingly, the operating frequency bands of the dual polarized antenna 100A include a frequency of between about 4 [GHz] and 5 [GHz], and a frequency of between about 6.4 [GHz] and 7 [GHz].

In FIG. 10B, at a frequency of between about 4 [GHz] and 5 [GHz], values of $S_{21}$ and $S_{12}$ in a case in which the small-diameter conductor pin 197 is placed are less than those in a case in which the small-diameter conductor pin 197 is not placed. At a frequency of between about 6.4 [GHz] and 7 [GHz], values of $S_{21}$ and $S_{12}$ in a case in which the small-diameter conductor pin 197 is placed are less than those in a case in which the small-diameter conductor pin 197 is not placed, in a frequency band of a frequency of approximately 6.7 [GHz] or more. As described above, isolation can be increased in the operating frequency bands of the dual polarized antenna 100A by placing the small-diameter conductor pin 197 including the plural pins in the inner diameters of the ring-shaped conductor layer 13 and the small-sized ring-shaped conductor layer 22 in planar view from the direction of the layering, and by connecting the small-diameter conductor pin 197 to the reference potential conductor layer 18.

Like the conductor pin 19, isolation can be increased in the plural operating frequency bands even when the small-diameter conductor pin 197 including the plural pins spaced from each other is placed in the inner diameters of the ring-shaped conductor layer 13 and the small-sized ring-shaped conductor layer 22 in planar view from the direction of the layering, and the small-diameter conductor pin 197 is connected to the reference potential conductor layer 18, in accordance with the dual polarized antenna 100A according to Embodiment 5, as described above. Accordingly, the dual polarized antenna 100A with favorable isolation characteristics can be obtained in the operating frequency bands of the dual polarized antenna 100A.

Embodiment 6

In Embodiment 5, the pins of the small-diameter conductor pin 197 are spaced from each other. This disclosure is not limited thereto. In Embodiment 6, the pins of a small-diameter conductor pin 197 are placed in contact with each other.

Figure 11A:
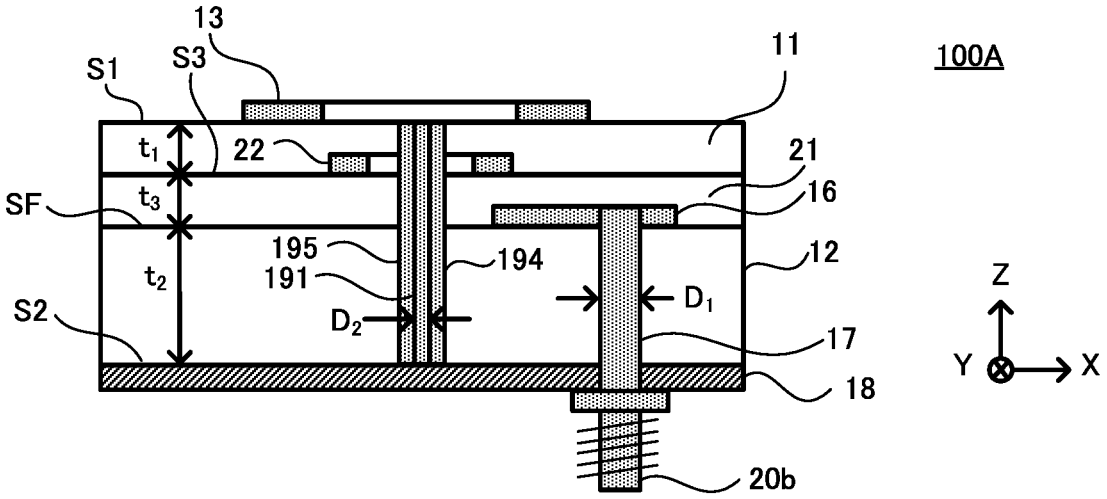
FIG. 11A is a cross-sectional view of an antenna according to Embodiment 6.
Figure 11B:
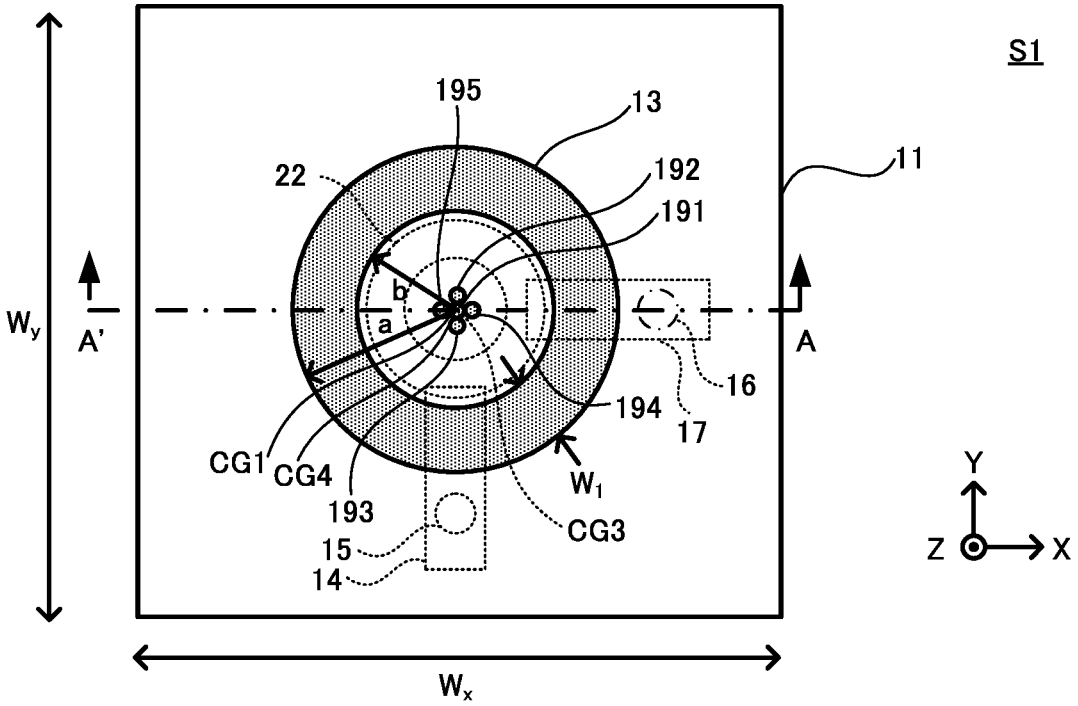
FIG. 11B is a plan view of a first surface of the antenna according to Embodiment 6.
Figure 11C:
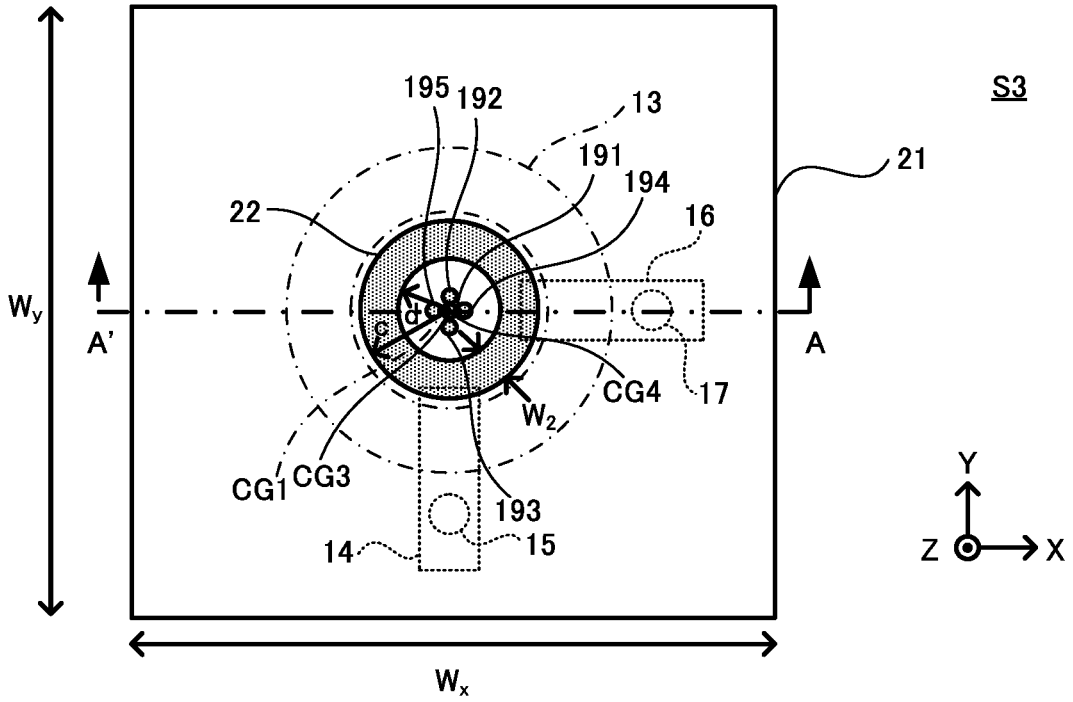
FIG. 11C is a plan view of a third surface of the antenna according to Embodiment 6.
Figure 11D:
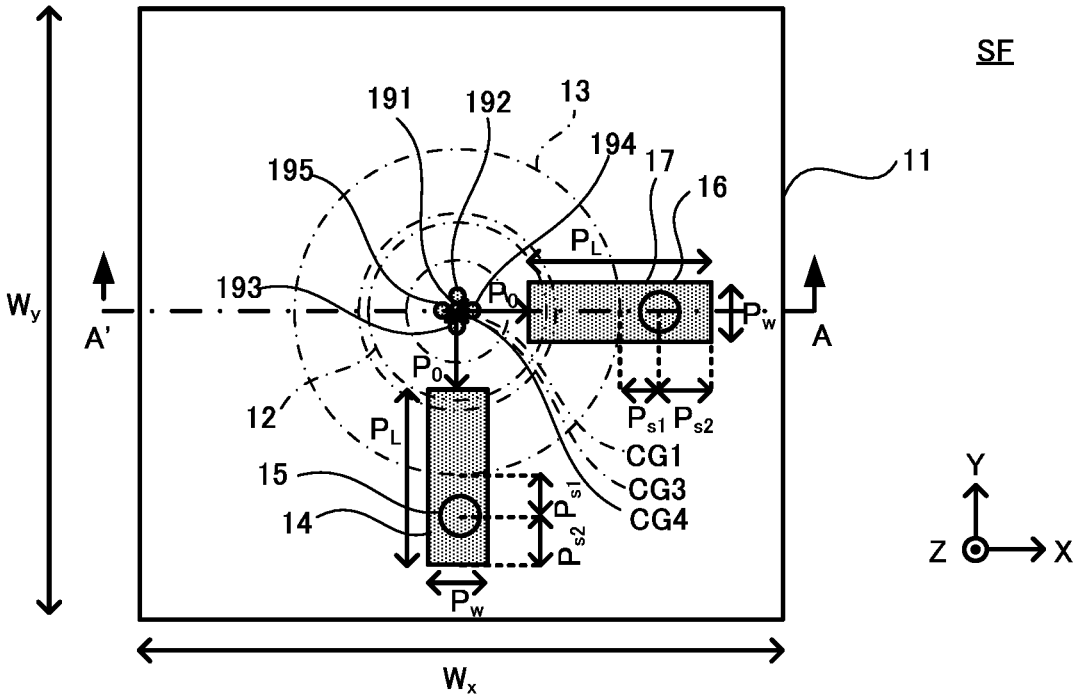
FIG. 11D is a plan view of a surface, on which feedlines are formed, of the antenna according to Embodiment 6.

The configurations of a dual polarized antenna 100A according to Embodiment 6 are illustrated in FIGS. 11A to 11D. FIG. 11A is a cross-sectional view of the dual polarized antenna 100A. FIG. 11B is a plan view of a first surface S1. FIG. 11C is a plan view of a third surface S3. FIG. 11D is a plan view of a surface SF on which feedlines are formed. The cross-sectional view of FIG. 11A corresponds to a cross-sectional view taken along the arrow A-A' in FIGS. 11B to 11D.

The first to fifth small-diameter conductor pins 191 to 195 pass through through-holes formed in a first dielectric layer 11, a second dielectric layer 12, and a third dielectric layer 21. One ends of the first to fifth small-diameter conductor pins 191 to 195 are connected to a reference potential conductor layer 18, and the other ends of the first to fifth small-diameter conductor pins 191 to 195 are located in the vicinity of the center of a ring-shaped conductor layer 13 on the first surface S1 of the first dielectric layer 11. Since the first to fifth small-diameter conductor pins 191 to 195 are connected to the reference potential conductor layer 18, the potentials of the first to fifth small-diameter conductor pins 191 to 195 are equal to a reference potential, and the potentials in the vicinities of the centers of the ring-shaped conductor layer 13 and a small-sized ring-shaped conductor layer 22 are close to the reference potential.

The first small-diameter conductor pin 191 extends in the Z-axis direction, and is placed so that the center of gravity CG4 of the first small-diameter conductor pin 191 fits with the central portions of the inner diameters of the ring-shaped conductor layer 13 and the small-sized ring-shaped conductor layer 22, that is, the center of gravity CG1 of the ring-shaped conductor layer 13 and the center of gravity CG3 of the small-sized ring-shaped conductor layer 22, in planar view from the direction of layering. Each of the second to fifth small-diameter conductor pins 192 to 195 is not spaced from the first small-diameter conductor pin 191, but is placed in contact with the first small-diameter conductor pin 191. The second to fifth small-diameter conductor pins 192 to 195 may be spaced from each other, or may come in contact with each other. Hereinafter, the first small-diameter conductor pin 191, the second small-diameter conductor pin 192, the third small-diameter conductor pin 193, the fourth small-diameter conductor pin 194, and the fifth small-diameter conductor pin 195 are collectively referred to as the small-diameter conductor pin 197.

Each of the other configurations of the dual polarized antenna 100A according to Embodiment 6 is similar to that in Embodiment 5.

In Embodiment 6, the position having the reference potential can be fixed in the inner diameters of the ring-shaped conductor layer 13 and the small-sized ring-shaped conductor layer 22 by placing the small-diameter conductor pin 197 in the inner diameters of the ring-shaped conductor layer 13 and the small-sized ring-shaped conductor layer 22 in planar view from the direction of the layering, and by connecting the small-diameter conductor pin 197 to the reference potential conductor layer 18. As a result, like the conductor pins 19 described in Embodiments 1 to 4, the symmetry properties in the XY plane of the potentials of the ring-shaped conductor layer 13 and the small-sized ring-shaped conductor layer 22 are considered to be improved to enable an increase in isolation in the operating frequency band of the dual polarized antenna 100A.

It will now be investigated whether or not isolation can be increased by placing the small-diameter conductor pin 197 in the inner diameters of the ring-shaped conductor layer 13 and the small-sized ring-shaped conductor layer 22 in planar view from the direction of the layering, and by connecting the small-diameter conductor pin 197 to the reference potential conductor layer 18 when the dual polarized antenna 100A in Embodiment 6 is produced under the following conditions.

All the diameters $D_2$ of the first small-diameter conductor pin 191, the second small-diameter conductor pin 192, the third small-diameter conductor pin 193, the fourth small-diameter conductor pin 194, and the fifth small-diameter conductor pin 195 are allowed to have the same size, and the diameter $D_2$ is changed to four kinds of 0.6 [mm], 0.9 [mm], 1.2 [mm], and 1.5 [mm]. The other conditions are similar to those of Embodiment 3.

Figure 12A:
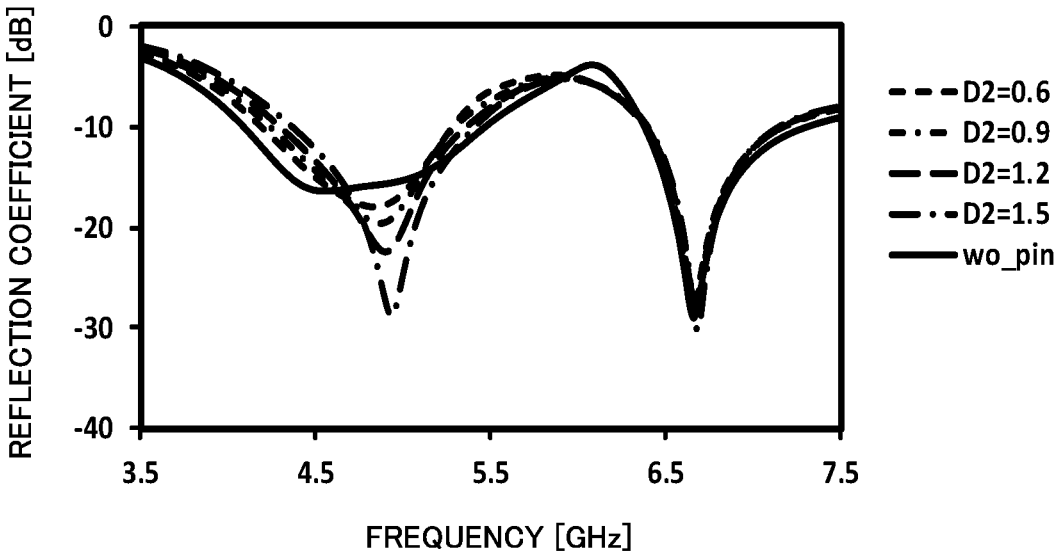
FIG. 12A is a view illustrating the reflection characteristics of the antenna according to Embodiment 6.
Figure 12B:
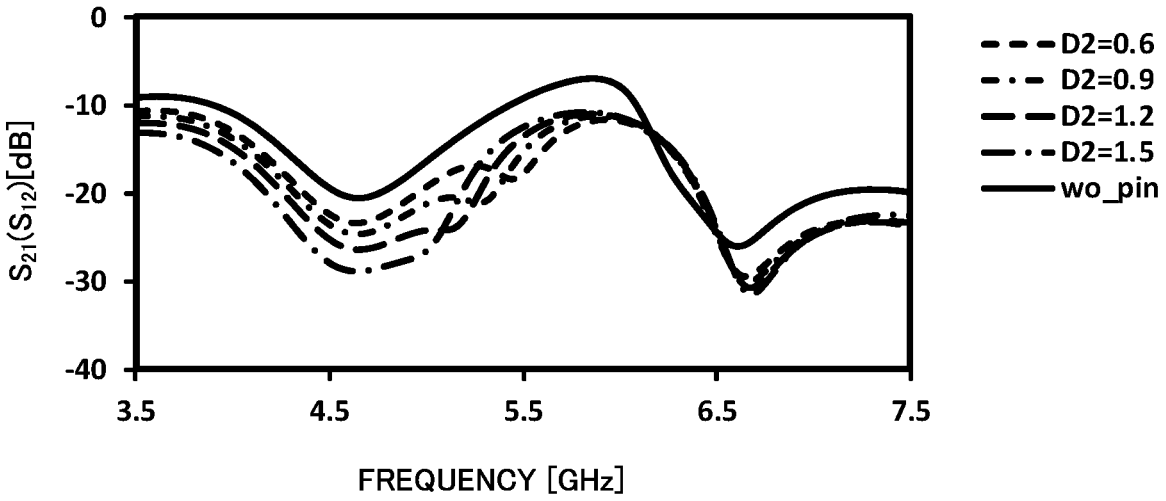
FIG. 12B is a view illustrating the isolation characteristics of the antenna according to Embodiment 6.

Reflection and isolation characteristics in the case of forming the dual polarized antenna 100A under the conditions described above are illustrated in FIGS. 12A and 12B. FIG. 12A is a view illustrating the reflection characteristics of the dual polarized antenna 100A. FIG. 12B is a view illustrating the isolation characteristics between a first feed port 15 and a second feed port 17.

In FIGS. 12A and 12B, the continuous lines indicate a case in which the small-diameter conductor pin 197 is not placed, and the dashed lines and the alternate long and short dash lines indicate a case in which the small-diameter conductor pin 197 is placed. Among the dashed lines, the small dashed lines indicate a case in which each pin of the small-diameter conductor pin 197 has a diameter $D_2$ of 0.6 [mm], and the large dashed lines indicate a case in which each pin of the small-diameter conductor pin 197 has a diameter $D_2$ of 1.2 [mm]. Among the alternate long and short dash lines, the small alternate long and short dash lines indicate a case in which each pin of the small-diameter conductor pin 197 has a diameter $D_2$ of 0.9 [mm], and the large alternate long and short dash lines indicate a case in which each pin of the small-diameter conductor pin 197 has a diameter $D_2$ of 1.5 [mm].

Commonly, the operating frequency bands of the dual polarized antenna 100A are frequency bands in which a reflection coefficient is −10 [dB] or less. In FIG. 12A, the frequency in which the reflection coefficient is −10 [dB] is between about 4 [GHz] and 5 [GHz], and between about 6.4 [GHz] and 7 [GHz]. Accordingly, the operating frequency bands of the dual polarized antenna 100A include a frequency of between about 4 [GHz] and 5 [GHz], and a frequency of between about 6.4 [GHz] and 7 [GHz].

In FIG. 12B, at a frequency of between about 4 [GHz] and 5 [GHz], values of $S_{21}$ and $S_{12}$ in a case in which the small-diameter conductor pin 197 is placed are less than those in a case in which the small-diameter conductor pin 197 is not placed. At a frequency of between about 6.4 [GHz] and 7 [GHz], values of $S_{21}$ and $S_{12}$ in a case in which the small-diameter conductor pin 197 is placed in the inner diameter of the small-sized ring-shaped conductor layer 22 are less than those in a case in which the small-diameter conductor pin 197 is not placed in the inner diameter of the small-sized ring-shaped conductor layer 22, in a frequency band of a frequency of approximately 6.5 [GHz] or more. As described above, isolation can be increased in the plural operating frequency bands of the dual polarized antenna 100A by placing the small-diameter conductor pin 197 including the plural pins in the inner diameters of the ring-shaped conductor layer 13 and the small-sized ring-shaped conductor layer 22 in planar view from the direction of the layering, and by connecting the small-diameter conductor pin 197 to the reference potential conductor layer 18.

Like the conductor pin 19, isolation can be increased in the plural operating frequency bands even when the small-diameter conductor pin 197 including the plural pins coming in contact with each other is placed in the inner diameters of the ring-shaped conductor layer 13 and the small-sized ring-shaped conductor layer 22 in planar view from the direction of the layering, and the small-diameter conductor pin 197 is connected to the reference potential conductor layer 18, in accordance with the dual polarized antenna 100A according to Embodiment 6, as described above.

Alternative Examples

The present disclosure is not limited to Embodiments 1 to 6 described above. It will be appreciated that various modifications can be made to the present disclosure without departing from the gist of the present disclosure.

Figure 13A:
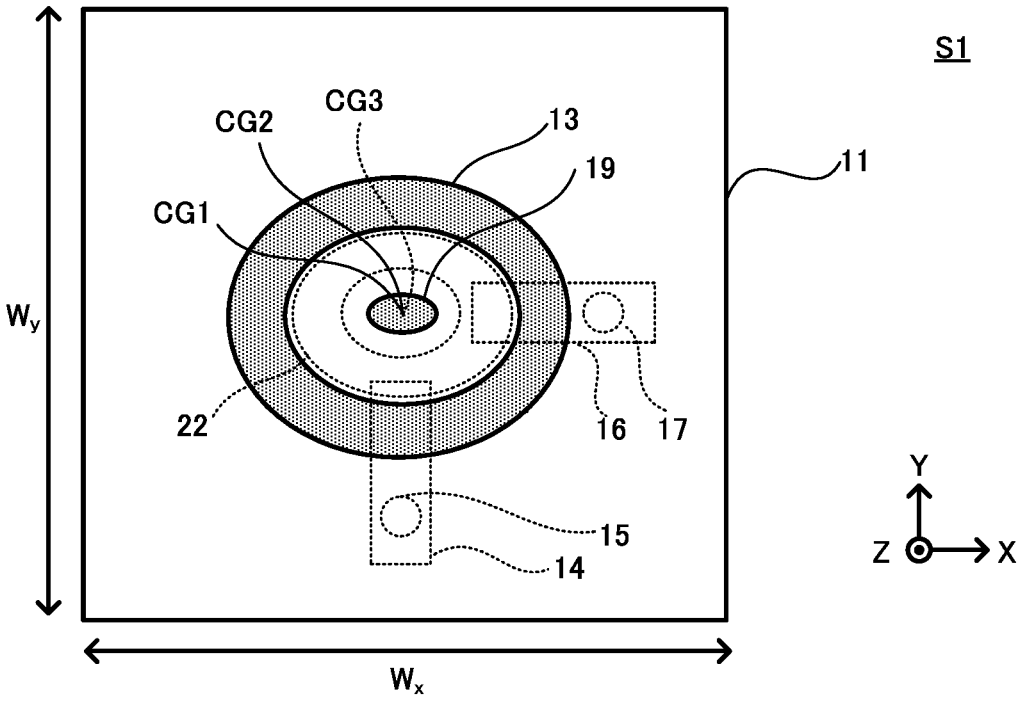
FIG. 13A is a plan view illustrating a first surface of an antenna according to an alternative example.
Figure 13B:
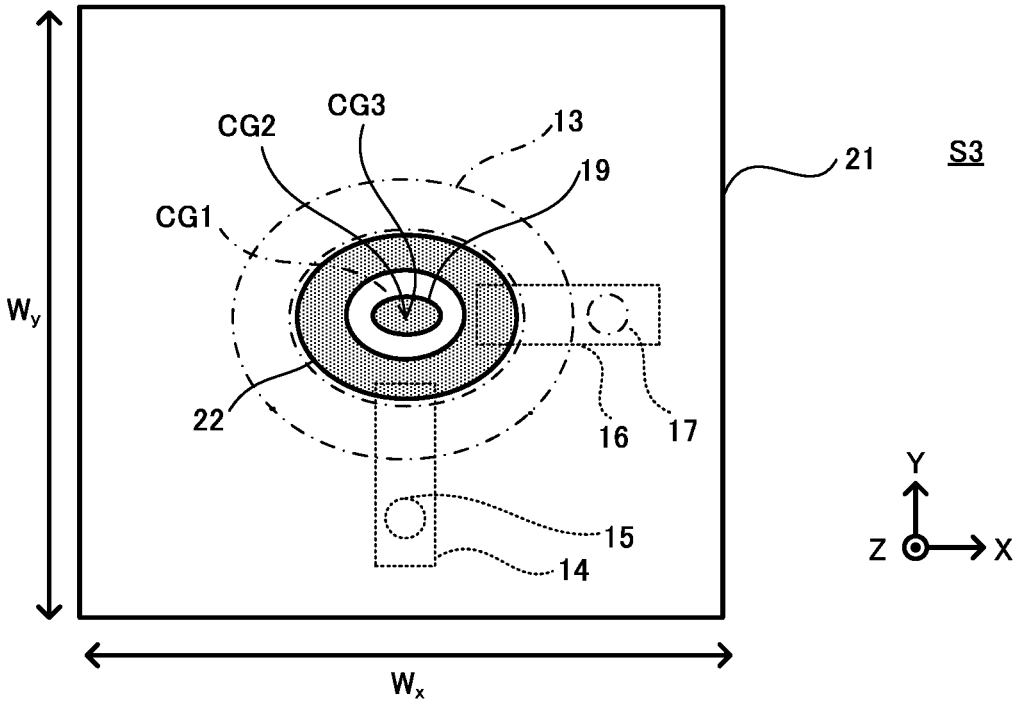
FIG. 13B is a plan view illustrating a third surface of the antenna according to the alternative example.
Figure 14A:
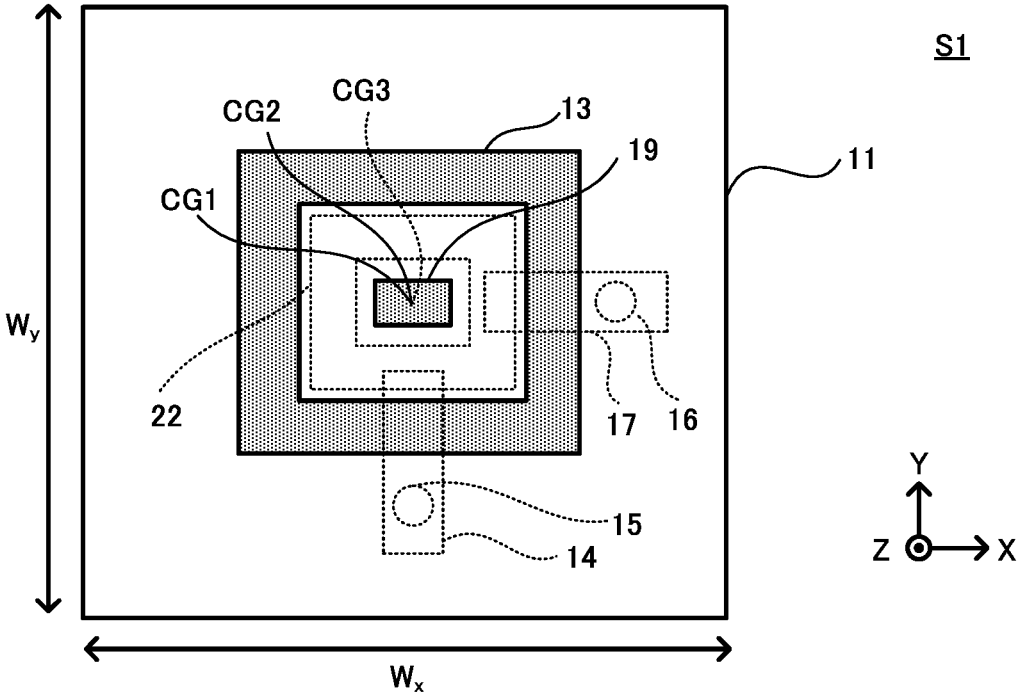
FIG. 14A is a plan view illustrating a first surface of an antenna according to an alternative example.
Figure 14B:
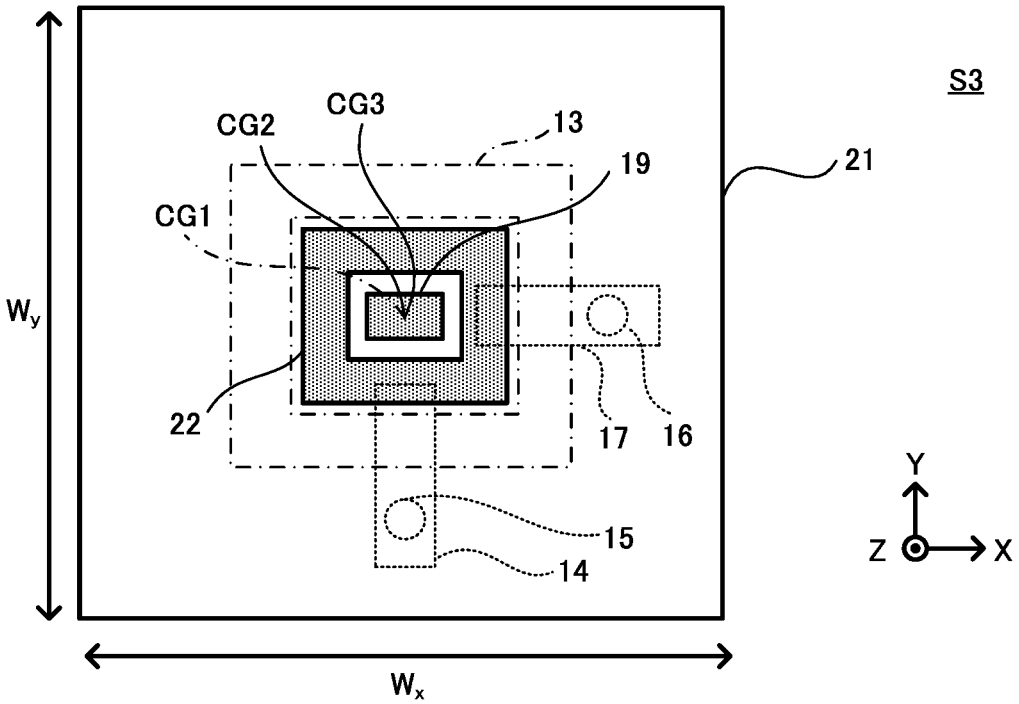
FIG. 14B is a plan view illustrating a third surface of the antenna according to the alternative example.

In each of Embodiments 1 to 6 described above, the ring-shaped conductor layer 13 and the small-sized ring-shaped conductor layer 22 have circular shapes in planar view from the direction of the layering. Without limitation thereto, for example, a ring-shaped conductor layer 13 and a small-sized ring-shaped conductor layer 22 may have elliptical shapes in planar view from the direction of layering as illustrated in FIGS. 13A and 13B, or may have quadrangular shapes in planar view from the direction of layering as illustrated in FIGS. 14A and 14B.

In Embodiments 1 to 4 described above, the conductor pin 19 has a circular shape in planar view from the direction of the layering. However, for example, a conductor pin 19 may have an elliptical shape in planar view from the direction of layering as illustrated in FIGS. 13A and 13B, or may have a quadrangular shape in planar view from the direction of layering as illustrated in FIGS. 14A and 14B. In addition, in each of Embodiments 5 and 6 described above, each pin of the small-diameter conductor pin 197 has a circular shape in planar view from the direction of the layering. Like the conductor pin 19, however, for example, each pin of a small-diameter conductor pin 197 may have an elliptical shape in planar view from the direction of layering, or may have a quadrangular shape in planar view from the direction of layering.

In Embodiments 1 to 6 described above, each of the first feedline 14 and the second feedline 16 has a rectangular shape in planar view from the direction of the layering. The shape of each of the first feedline 14 and the second feedline 16 is not limited thereto. Each of the first feedline 14 and the second feedline 16 may have any shape as long as the extending directions of first feedline 14 and the second feedline 16 intersect with each other in the planar view from the direction of the layering. In Embodiments 1 to 6 described above, the first feedline 14 and the second feedline 16 include a conductor film, foil, or plate, or the like. However, the first feedline 14 and the second feedline 16 may include another material.

In Embodiments 1 to 6 described above, the extending directions of the first feedline 14 and the second feedline 16 intersect orthogonally with each other in planar view from the direction of the layering. Without limitation thereto, the intersection angle may deviate from 90° in planar view from the direction of the layering as long as the dual polarized antenna 100 (100A) substantially functions as a dual orthogonally polarized antenna.

In Embodiments 1 to 6 described above, the potential of the reference potential conductor layer 18 is set at a ground potential which is a zero potential. Without limitation thereto, the potential of the reference potential conductor layer 18 may be set at an optional reference potential.

Figure 15A:
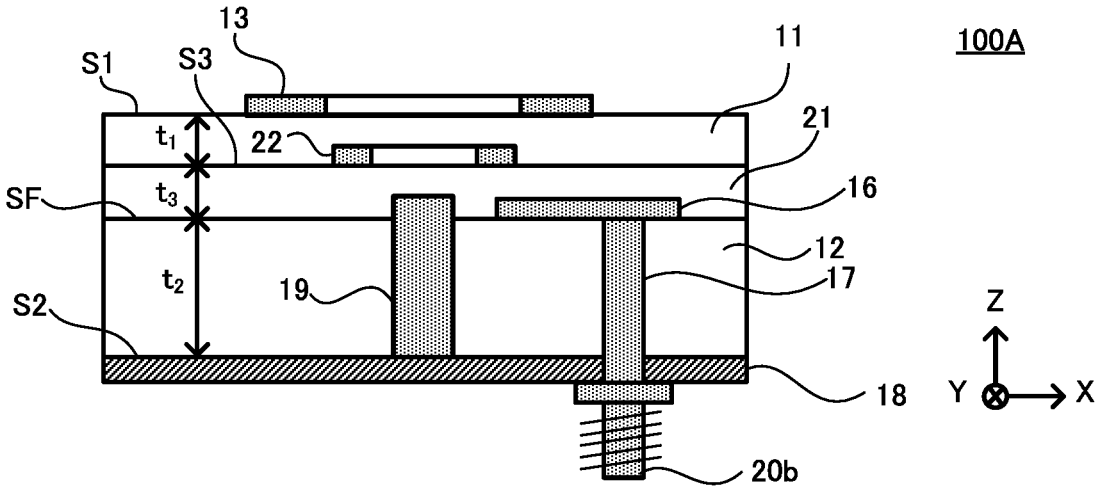
FIG. 15A is a cross-sectional view of an antenna according to an alternative example.
Figure 15B:
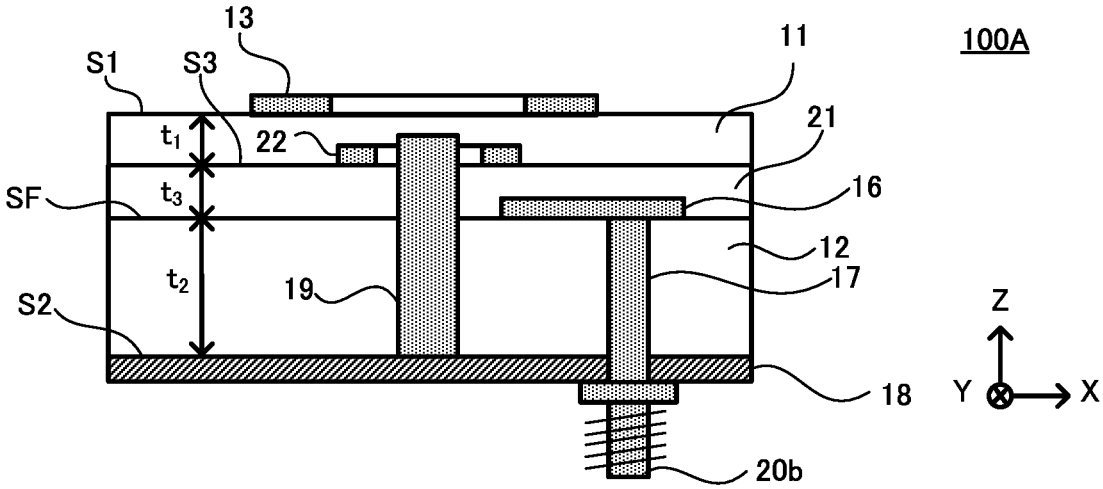
FIG. 15B is a cross-sectional view of an antenna according to an alternative example.

In Embodiments 1 to 6 described above, one end of each of the conductor pin 19 and the small-diameter conductor pin 197 is connected to the reference potential conductor layer 18, and the other end thereof is located on the first surface S1 of the first dielectric layer 11. Without limitation thereto, it is also acceptable that, for example, as illustrated in FIGS. 15A and 15B, one end of a conductor pin 19 is connected to a reference potential conductor layer 18, and the other end of the conductor pin 19 is located at a position closer to a second surface S2 of a second dielectric layer 12 than to a first surface S1 of a first dielectric layer 11. The same also applies to the small-diameter conductor pin 197.

Figure 16A:
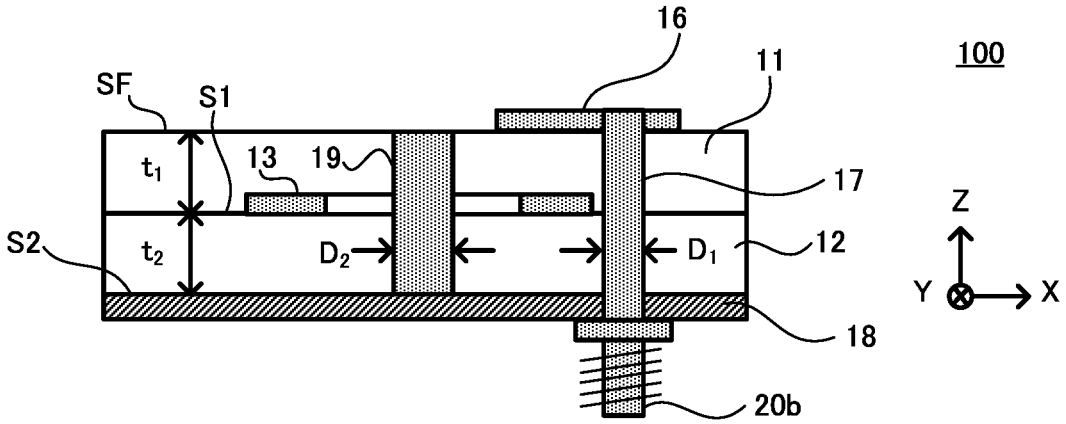
FIG. 16A is a cross-sectional view of an antenna according to an alternative example.

In Embodiments 1 and 2 described above, the first surface S1 on which the ring-shaped conductor layer 13 is formed, the surface SF on which the feedlines are formed (on which the first feedline 14 and the second feedline 16 are formed), and the second surface S2 on which the reference potential conductor layer 18 is formed, in the order mentioned above, are placed in the layering. Without limitation thereto, for example, as illustrated in FIG. 16A, a surface SF on which feedlines are formed (on which a first feedline 14 and a second feedline 16 are formed), a first surface S1 on which a ring-shaped conductor layer 13 is formed, and a second surface S2 on which a reference potential conductor layer 18 is formed, in the order mentioned above, may be placed in layering.

In Embodiments 3 to 6 described above, the small-sized ring-shaped conductor layer 22 of which the inner and outer diameters are smaller than those of the ring-shaped conductor layer 13 is described as an example of the second ring-shaped conductor layer in the claims. However, the second ring-shaped conductor layer is not limited thereto. The second ring-shaped conductor layer preferably functions as a radiating element for transmitting and receiving third and fourth polarized waves of which the frequency bands are different from the frequency band of the ring-shaped conductor layer 13. Therefore, at least one of the inner and outer diameters of the second ring-shaped conductor layer may be different from that of the ring-shaped conductor layer 13.

Figure 16B:
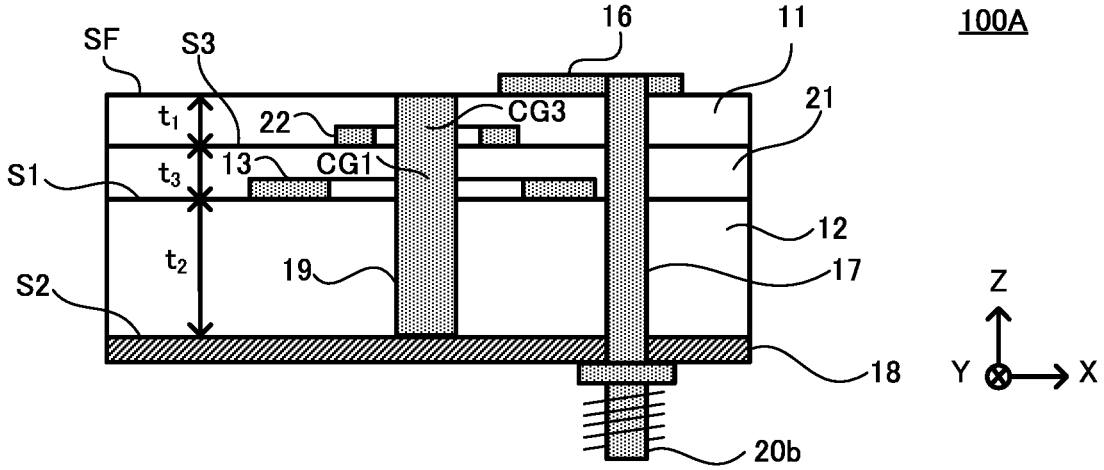
FIG. 16B is a cross-sectional view of an antenna according to an alternative example.

In Embodiments 3 to 6 described above, the first surface S1 on which the ring-shaped conductor layer 13 is formed, the third surface S3 on which the small-sized ring-shaped conductor layer 22 is formed, the surface SF on which the feedlines are formed (on which the first feedline 14 and the second feedline 16 are formed), and the second surface S2 on which the reference potential conductor layer 18 is formed, in the order mentioned above, are placed in the layering. Without limitation thereto, for example, as illustrated in FIG. 16B, a surface SF on which feedlines are formed (on which a first feedline 14 and a second feedline 16 are formed), a third surface S3 on which a small-sized ring-shaped conductor layer 22 is formed, a first surface S1 on which a ring-shaped conductor layer 13 is formed, and a second surface S2 on which a reference potential conductor layer 18 is formed, in the order mentioned above, may be placed in layering.

Figure 17:
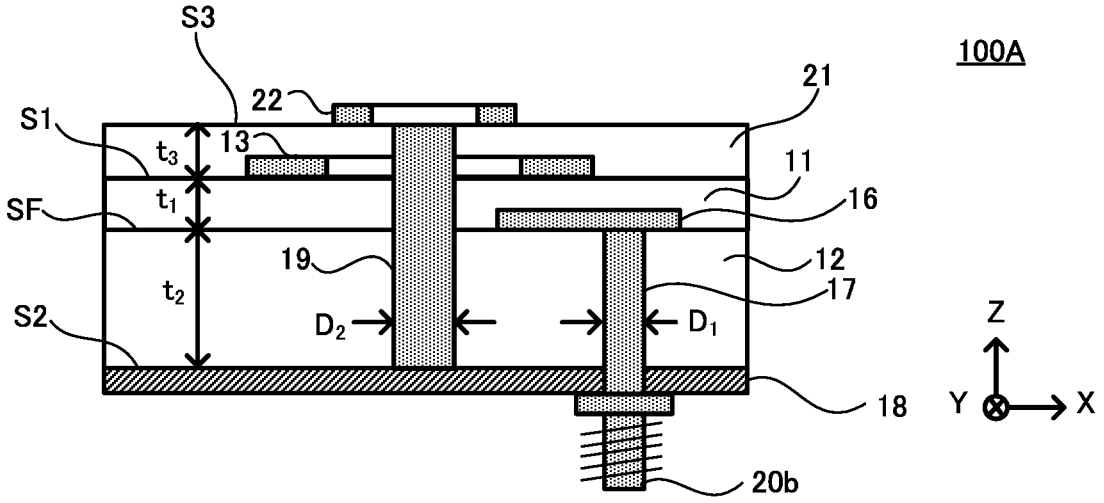
FIG. 17 is a cross-sectional view of an antenna according to an alternative example.

In Embodiments 3 to 6 described above, and the above-mentioned alternative examples, the first surface S1 which is the principal surface in the +Z-axis direction of the first dielectric layer 11, the third surface S3 which is the principal surface in the +Z-axis direction of the third dielectric layer 21, coming in contact with the first dielectric layer 11, the surface SF on which the feedlines are formed, and which is the principal surface in the +Z-axis direction of the second dielectric layer 12, coming in contact with the third dielectric layer 21, and the second surface S2 which is the principal surface in the −Z-axis direction of the second dielectric layer 12, in the order mentioned above, are placed in the layering. Without limitation thereto, it is also acceptable that, for example, as illustrated in FIG. 17, a third dielectric layer 21, a first dielectric layer 11, and a second dielectric layer 12 in the order mentioned above are layered, a principal surface in the +Z-axis direction of the third dielectric layer 21 is allowed to be a third surface S3, and a principal surface in the +Z-axis direction of the first dielectric layer 11, coming in contact with the third dielectric layer 21, is allowed to be a first surface S1. In this case, the third surface S3, the first surface S1, a surface SF on which feedlines are formed, and which is a principal surface in the +Z-axis direction of the second dielectric layer 12, coming in contact with the first dielectric layer 11, and a second surface S2 which is a principal surface in the −Z-axis direction of the second dielectric layer 12, in the order mentioned above, are placed in layering. In other words, the third surface S3 on which a small-sized ring-shaped conductor layer 22 is formed is a surface different from the first surface S1, the second surface S2, and the surface SF on which the feedlines are formed, and is preferably located at a position closer to the first surface S1 than to the second surface S2.

Figure 18A:
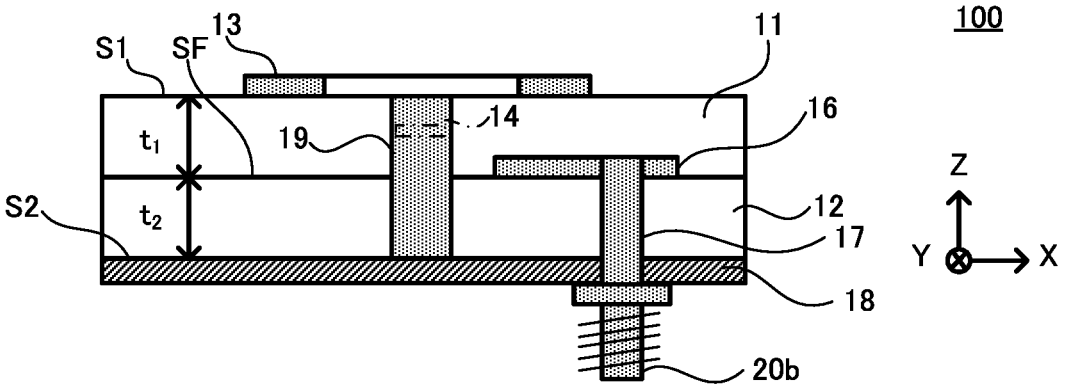
FIG. 18A is a cross-sectional view of an antenna according to an alternative example.
Figure 18B:
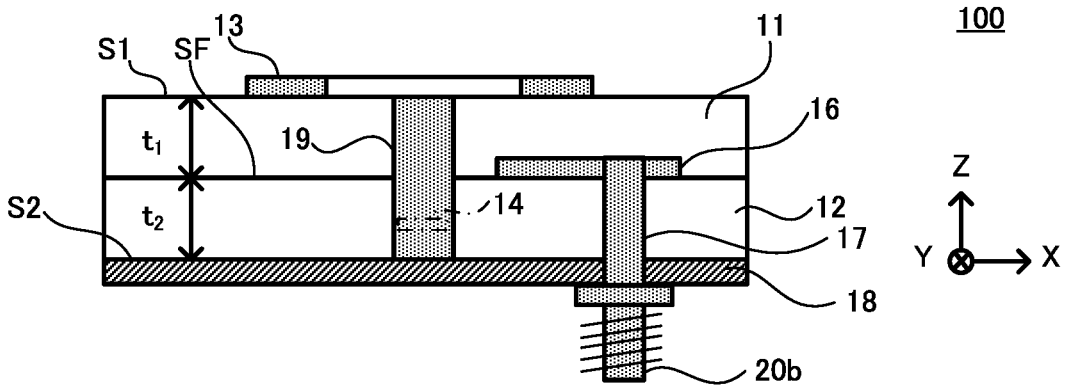
FIG. 18B is a cross-sectional view of an antenna according to an alternative example.

In Embodiments 1 to 6 described above, and the above-mentioned alternative examples, the first feedline 14 and the second feedline 16 are placed on the identical surface of the dielectric layer. Without limitation thereto, a first feedline 14 and a second feedline 16 may be placed at positions different from those on the identical surface of the dielectric layer. In FIGS. 18A and 18B, the originally invisible first feedline 14 is indicated by an alternate long and short dash line. In FIG. 18A, for example, the first feedline 14 is placed at the position closer to a first surface S1 than a surface SF on which the feedline is formed (on which the second feedline 16 is placed). In FIG. 18B, for example, the first feedline 14 is placed at the position closer to a second surface S2 than the surface SF on which the feedline is formed. The first feedline 14 and the second feedline 16 may be inversely placed.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. An antenna comprising:

a dielectric layer comprising a first surface and a second surface that is different from the first surface, the first surface and the second surface being placed in layering;

a first ring-shaped conductor layer with a ring shape, formed on the first surface;

a first feedline and a second feedline that are closer to the first surface than to the second surface, and that are formed at positions different from positions of the first surface and the second surface;

a reference potential conductor layer formed on the second surface; and a conductor pin that is located in an inner diameter of the first ring-shaped conductor layer in planar view from a direction of the layering, and that is connected to the reference potential conductor layer, wherein the first feedline and the second feedline comprise portions overlapping with the first ring-shaped conductor layer in the planar view from the direction of the layering, an extending direction of the first feedline and an extending direction of the second feedline intersect with each other in the planar view from the direction of the layering, the first ring-shaped conductor layer is connected to neither the reference potential conductor layer nor the conductor pin, and neither the first feedline nor the second feedline is connected to the conductor pin.

2. The antenna according to claim 1, wherein a center of gravity of the conductor pin is at a position closer to at least one of the first feedline and the second feedline than a center of gravity of the first ring-shaped conductor layer in the planar view from the direction of the layering.

3. The antenna according to claim 2, wherein the dielectric layer further comprises a third surface that is different from the first surface and the second surface, and that is located at a position closer to the first surface than to the second surface, the first feedline and the second feedline are formed at positions different from a position of the third surface, and the antenna further comprises a second ring-shaped conductor layer which is formed on the third surface, and of which at least one of inner and outer diameters is different from that of the first ring-shaped conductor layer.

4. The antenna according to claim 1, wherein the dielectric layer further comprises a third surface that is different from the first surface and the second surface, and that is located at a position closer to the first surface than to the second surface, the first feedline and the second feedline are formed at positions different from a position of the third surface, and the antenna further comprises a second ring-shaped conductor layer which is formed on the third surface, and of which at least one of inner and outer diameters is different from that of the first ring-shaped conductor layer.

* * * * *